US011534645B2

(12) United States Patent
Forell

(10) Patent No.: US 11,534,645 B2
(45) Date of Patent: Dec. 27, 2022

(54) WEIGHT LIFTING SUPPORT SHIRT

(71) Applicant: Robert Allen Forell, Lucinda, PA (US)

(72) Inventor: Robert Allen Forell, Lucinda, PA (US)

( * ) Notice: Subject to any disclaimer, the term of this patent is extended or adjusted under 35 U.S.C. 154(b) by 0 days.

(21) Appl. No.: 17/340,126

(22) Filed: Jun. 7, 2021

(65) Prior Publication Data

US 2022/0134163 A1 May 5, 2022

Related U.S. Application Data

(60) Provisional application No. 63/107,039, filed on Oct. 29, 2020.

(51) Int. Cl.

| | |
|---|---|
| ***A63B 21/00*** | (2006.01) |
| ***A41D 13/00*** | (2006.01) |
| ***A63B 21/078*** | (2006.01) |
| ***A41D 27/06*** | (2006.01) |
| ***A41D 27/10*** | (2006.01) |
| ***A41D 31/18*** | (2019.01) |

(52) U.S. Cl.

CPC .... *A63B 21/00181* (2013.01); *A41D 13/0015* (2013.01); *A41D 27/06* (2013.01); *A41D 27/10* (2013.01); *A63B 21/078* (2013.01); *A63B 21/4001* (2015.10); *A41D 31/18* (2019.02)

(58) Field of Classification Search

None

See application file for complete search history.

(56) References Cited

U.S. PATENT DOCUMENTS

| | | | | |
|---|---|---|---|---|
| 3,116,735 | A * | 1/1964 | Geimer | A61F 5/026 450/2 |
| 5,582,583 | A * | 12/1996 | Ballantyne | A61F 5/013 2/243.1 |
| D718,016 | S * | 11/2014 | Cho | D2/702 |
| 10,405,589 | B1 | 9/2019 | Womack | |
| 11,369,151 | B2 * | 6/2022 | Forell | A63B 21/0552 |
| 2005/0009445 | A1 * | 1/2005 | Bell | A61F 5/03 450/1 |
| 2005/0197607 | A1 * | 9/2005 | Brown | A61N 1/0484 602/19 |

(Continued)

OTHER PUBLICATIONS

"First glance at Metal Jack bench shirt". Published Jun. 20, 2011. Accessed via Youtube.com on Jun. 1, 2021. https://www.youtube.com/watch?v=e8THtmSCYJg (Year: 2011).*

*Primary Examiner* — Jameson D Collier
*Assistant Examiner* — Matthew R Marchewka
(74) *Attorney, Agent, or Firm* — Ashok Tankha

(57) ABSTRACT

A weight lifting support shirt includes a chest support portion, a first arm support portion, a second arm support portion, a neck relief portion, a torso support portion, a first lateral extension, and a second lateral extension. A grid plate is disposed about a center of the chest support portion. The grid plate resists stretching of material of the chest support portion when a weight is lowered by a lifter and stores energy of the weight when the weight is lowered during a workout. The grid plate rebounds the stored energy into a chest portion and arms of the lifter when the weight is lifted by the lifter during the workout. The grid plate comprises a figure eight stitching. The figure eight stitching directs load and energy received from multiple angles during the workout, towards the center of the chest support portion.

16 Claims, 19 Drawing Sheets

(56) References Cited

U.S. PATENT DOCUMENTS

| | | | | |
|---|---|---|---|---|
| 2012/0059297 | A1* | 3/2012 | Newkirk | A61F 5/026 602/19 |
| 2015/0196072 | A1* | 7/2015 | Inzer | A41B 1/08 2/69 |
| 2017/0231798 | A1 | 8/2017 | Shin | |

* cited by examiner

WEIGHT LIFTING SUPPORT SHIRT

CROSS-REFERENCE TO RELATED APPLICATIONS

This application claims priority to and the benefit of the provisional patent application titled "Weight Lifting Support Shirt", application No. 63/107,039, filed in the United States Patent and Trademark Office on Oct. 29, 2020. The specification of the above referenced patent application is incorporated herein by reference in its entirety.

BACKGROUND

Physical exercise promotes the health and well-being of an individual. Physical activities are performed by exercising, cycling, running, outdoor sports, dancing, cross fit workouts, martial arts, gym-based workouts, weight lifting, etc. In general, gym-based workouts are generally a preferred workout because such workouts allow a person to exercise more parts of his body in a given period of time, build muscles, burn more calories, etc. As used herein, a barbell is an exercise equipment used in weight training, bodybuilding, weightlifting and powerlifting, consisting of a long bar, usually with weights attached at each end. Bench press of a barbell is a workout which is targeted for the development of the upper torso, arms and shoulders. However, workouts such as weight lifting performed by a weight lifter, hereafter referred to as 'lifter', in the gym requires careful attention regarding the workout method, and the body movements associated with such workouts.

Bench shirts for weight lifting are known in the art to assist a weight lifter in the weight lifting process. Prior art bench shirts include sleeves that enclose the upper arms of the user. The sleeves of the prior art bench shirt are generally tubular, composed of a resilient material, and define a shoulder end and an elbow end. When worn by a user, the shoulder ends of the sleeves of the prior art bench shirt are proximal to the user's shoulders. The elbow ends of the sleeves of the prior art bench shirt are proximal to the user's elbows. The prior art bench shirts include a resilient chest plate that is attached to and joins the shoulder end of the resilient sleeve portions. The chest plate extends across the chest of the user between the user's shoulders when the user is lying on the bench.

When performing a bench press, the user moves a weighted bar from pegs supporting the weighted bar above the user and lowers the weighted bar to the user's chest or to a predetermined height above the user's chest. As the user lowers the weighted bar, the chest plate and sleeves stretch between the user's shoulders and across the chest of the user. The stretching, resilient material of the bench shirt stores energy when the weight is lowered and applies a force in the upward direction to the upper arm of the user proximal to the user's shoulder to counter the downward force of the weighted bar. The upward force applied by the stretched, resilient chest plate assists the user in raising the weighted bar.

Furthermore, prior art bench shirts do not allow the lifter to follow a proper bar path when bench pressing, which is a substantially straight path, and substantially perpendicular to the ground. Furthermore, prior art bench shirts opt for narrower arm sleeve angles and looser chest regions that requires the lifter to adopt an uncomfortable and compromising grip on the barbell while working out. The lifter is often restricted to the point where the lifter is unable to grip the barbell at the proper position by themselves, and the assistance of a spotter is required to stretch the lifter's arms out to the sides to allow the lifter to grip the barbell at the proper position.

Therefore, there exists a need for a bench press shirt that provides the necessary flexibility to the lifter to allow the lifter to move the weight along a proper range of motion and depth when working out with the weight, for example, a barbell. There also exists a need for a bench press shirt that transfers the load and energy of the barbell to the center of the bench press shirt when the barbell is lowered by the lifter. There also exists a need for a bench press shirt that transfers the load and energy of the barbell from the center of the bench press shirt into the chest portion and the arms of the lifter when the barbell is raised by the lifter. There also exists a need for a bench press shirt that maximizes transfer of the load and energy of the barbell from the shoulders to the triceps, pectoral, and latissimus regions of the lifter, to reduce strain on the rotator cuffs and to stabilize the shoulder and shoulder girdle of the lifter while the bench press workout is performed.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The weight lifting support shirt disclosed herein addresses the need for a bench press shirt that provides the necessary flexibility to the lifter to allow a proper range of motion and depth when working out with a weight, for example, a barbell. The weight lifting support shirt disclosed herein addresses the need for a bench press shirt that transfers the load and energy of the barbell to the center of the bench press shirt when the barbell is lowered by the lifter. The weight lifting support shirt disclosed herein addresses the need for a bench press shirt that transfers the load and energy of the barbell from the center of the bench press shirt into the chest portion and the arms of the lifter when the barbell is raised by the lifter. The weight lifting support shirt disclosed herein addresses the need for a bench press shirt that maximizes transfer of the load and energy of the barbell from the shoulders to the triceps, pectoral, and latissimus regions of the lifter, to reduce strain on the rotator cuffs and stabilize the shoulder and shoulder girdle of the lifter while the bench press workout is performed.

The weight lifting support shirt comprises a chest support portion, a first arm support portion, a second arm support portion, a neck relief portion, a torso support portion, a first lateral extension and a second lateral extension. The chest support portion is configured to extend across a chest portion of the lifter from a first end to a second end of the chest support portion. The first arm support portion extends from the first end of the chest support portion, and the second arm support portion extends from the second end of the chest support portion. The first and second arm support portions are configured to accommodate and support a first upper arm and a second upper arm of the lifter, respectively. The neck relief portion is attached to an upper boundary of the chest support portion. The neck relief portion connects the first arm support portion to the second arm support portion.

The neck relief portion comprises elastic material that stretches to store energy when a weight is lowered by the lifter. The elastic material of the neck relief portion releases the stored energy and returns to an unstretched state of the elastic material when the weight is raised by the lifter while performing the workout with the weight. The torso support portion is in communication with and extends below the chest support portion. The first lateral extension extends from the first arm support portion and a first lateral side of the torso support portion. The second lateral extension extends from the second arm support portion and a second lateral side of the torso support portion. The first lateral extension is configured to wrap around a first shoulder and a back of the lifter and the second lateral extension is configured to wrap around a second shoulder and the back of the lifter.

In an embodiment, the weight lifting support shirt further comprises a grid plate disposed about a center of the chest support portion. The grid plate is configured to resist stretching of material of the chest support portion of the weight lifting support shirt when a weight is lowered by the lifter and to store energy of the weight when the weight is lowered. Furthermore, the grid plate is configured to rebound the stored energy into the chest portion and the arms of the lifter when the weight is lifted by the lifter. In an embodiment, the first arm support portion is configured to form a sleeve around the first upper arm of the lifter and the second arm support portion is configured to form a sleeve around the second upper arm of the lifter. The energy stored by the stretched elastic material of the neck relief portion allows the lifter to press the weight away from the lifter's body when the weight is raised by the lifter.

In an embodiment, the chest support portion is made of an elastic material. The chest support portion is configured to stretch and store energy when the weight is lowered by the lifter. The energy is received and stored at the center of the weight lifting support shirt. The stored energy rebounds through the chest portion and triceps of the lifter when the lifter presses the weight away from the body. In an embodiment, the neck relief portion and the chest support portion are made of the same elastic or other material.

In an embodiment, the first lateral extension comprises a loop component of a hook and loop fastener, for example, VELCRO® manufactured by VELCRO™ BVBA, attached to a lower surface of the first lateral extension. In this embodiment, the second lateral extension comprises a hook component of the hook and loop fastener attached to an upper surface of the second lateral extension. The torso support portion, the first lateral extension, and the second lateral extension are fastened to the torso of the lifter using the hook and loop fastener. In an embodiment, the first lateral extension is longer than the second lateral extension, and the first lateral extension is configured to overlap the second lateral extension when the weight lifting support shirt is worn by the lifter. In an embodiment, the center of the chest support portion is reinforced with figure eight stitching, which further concentrates load and energy received from multiple angles during the workout to the center of the weight lifting support shirt.

In another embodiment, the weight lifting support shirt disclosed herein comprises a pair of sleeves, a lower elastic section, and an upper elastic section. Each pair of sleeves is generally in the shape of a truncated cone configured to enclose an upper arm of a user. Each of the sleeves are resilient and each sleeve defines an elbow end and a shoulder end, where each sleeve defines a sleeve length between the shoulder end and the elbow end. Each sleeve defines an upper side, a lower side, an inner side and an outer side, where the upper side, lower side and outer sides of each sleeve are configured to enclose the upper arm of the user. The inner side of each sleeve defines a sleeve opening that extends from the shoulder end to a sleeve closure location and the sleeve opening defines opening edges.

The lower elastic section is resilient, and is attached to and extends between the opening edges of the inner side of the sleeves from the shoulder end of each sleeve to the sleeve closure location. The upper elastic section is resilient, and is attached to the lower elastic section and extends between the opening edges of the inner side of the sleeves from the sleeve closure location. The upper elastic section is closer to the user's face than the lower elastic section when the user is wearing the weight lifting support shirt. Therefore, the combination of the lower and upper elastic sections resiliently connects the sleeves.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein. The description of a method step or a component referenced by a numeral in a drawing is applicable to the description of that method step or component shown by that same numeral in any subsequent drawing herein.

DETAILED DESCRIPTION OF THE INVENTION

Figure 1A:
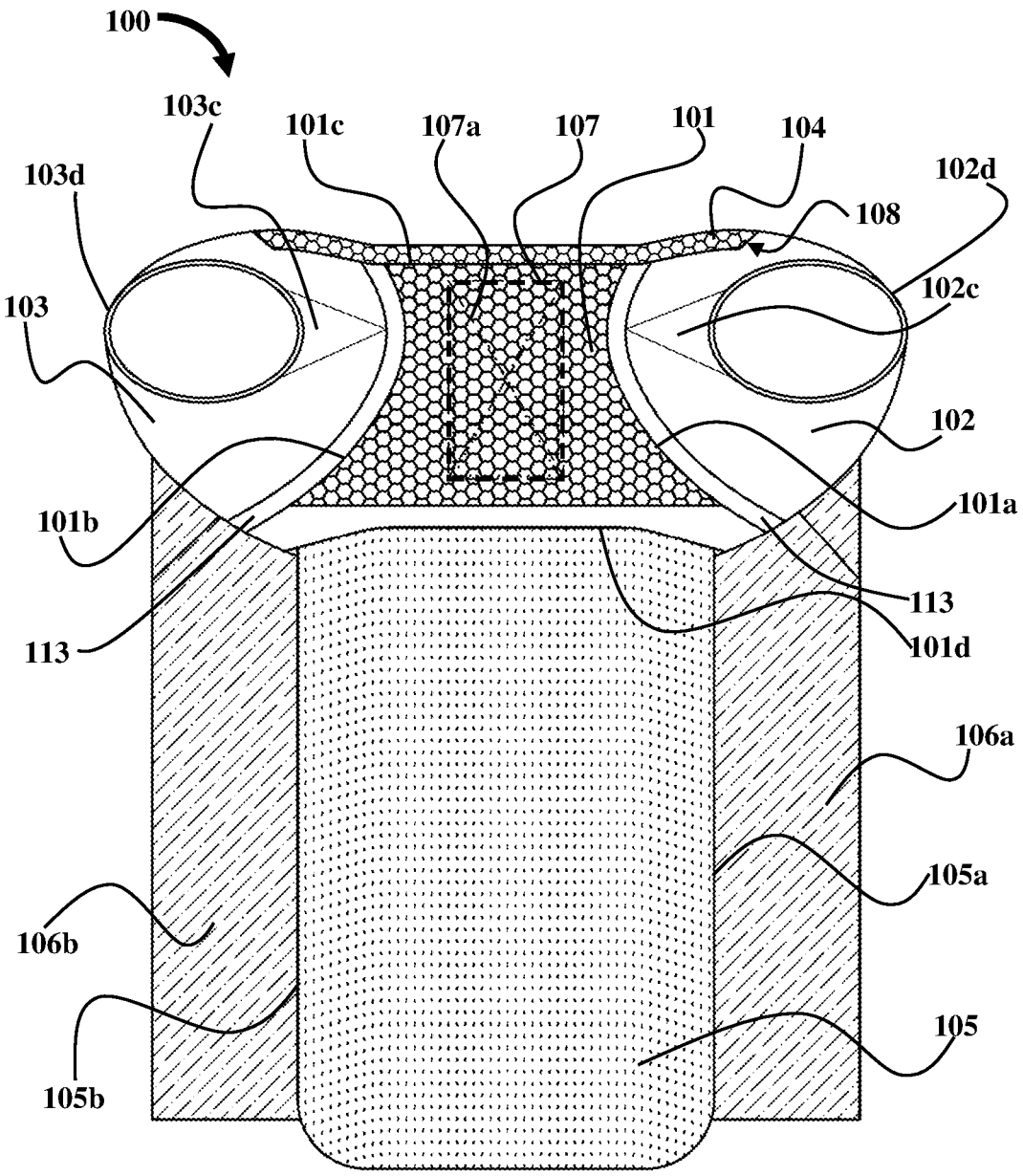
FIG. 1A exemplarily illustrates a front view of the weight lifting support shirt.
Figure 1B:
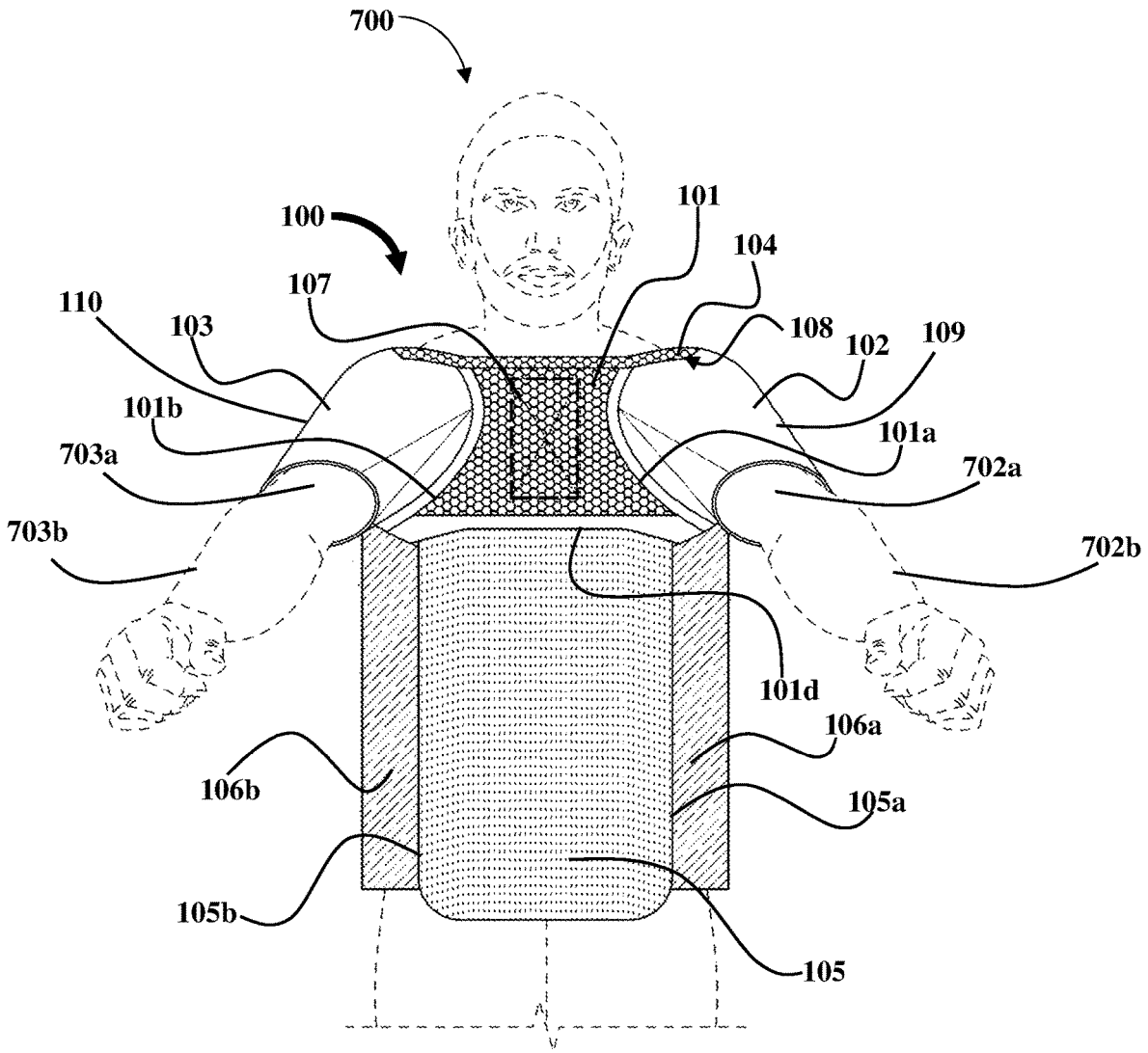
FIG. 1B exemplarily illustrates a front view of the weight lifting support shirt that is worn by the lifter in a standing position.
Figure 1C:
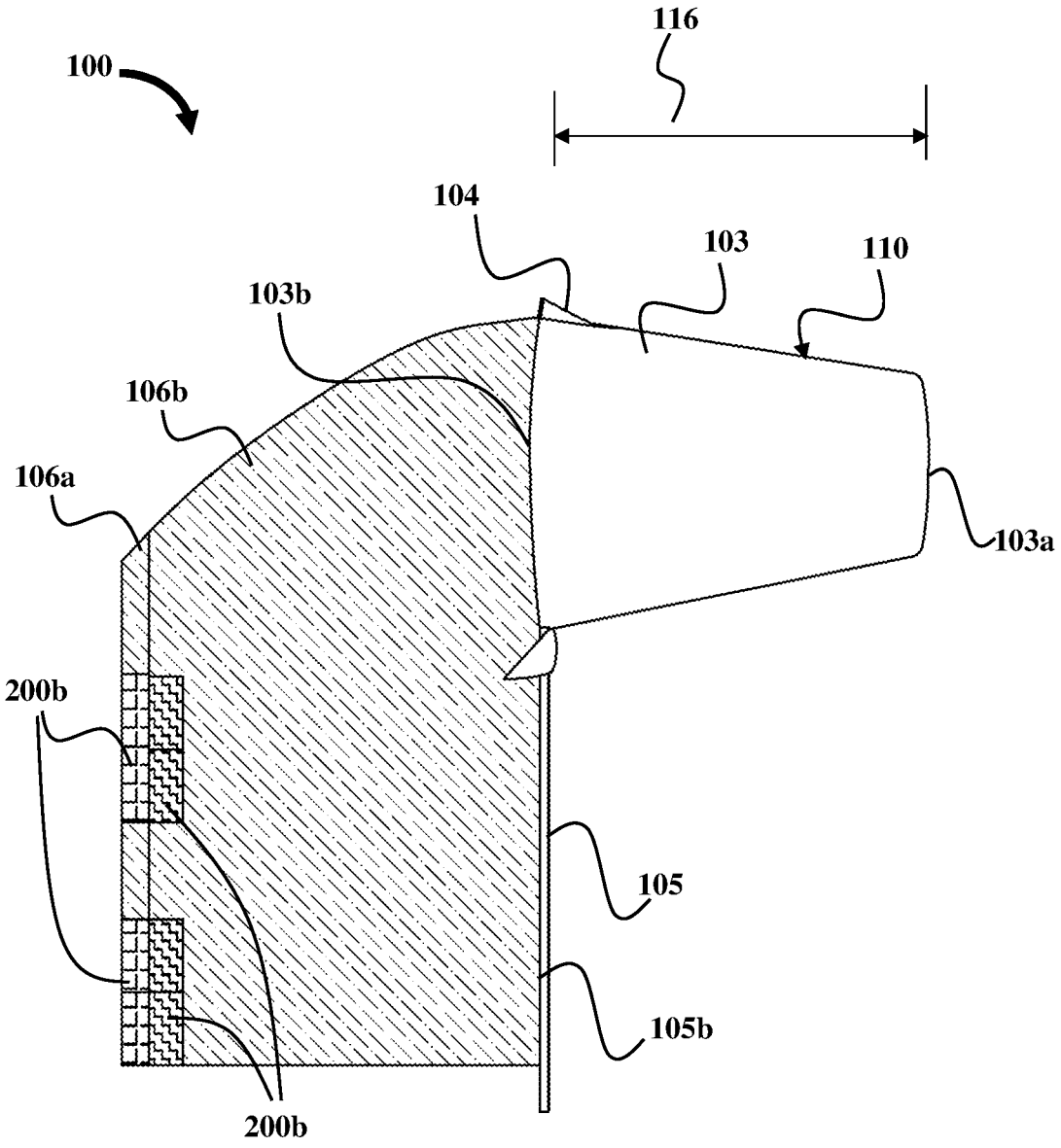
FIG. 1C exemplarily illustrates a left-side view of the weight lifting support shirt.
Figure 1D:
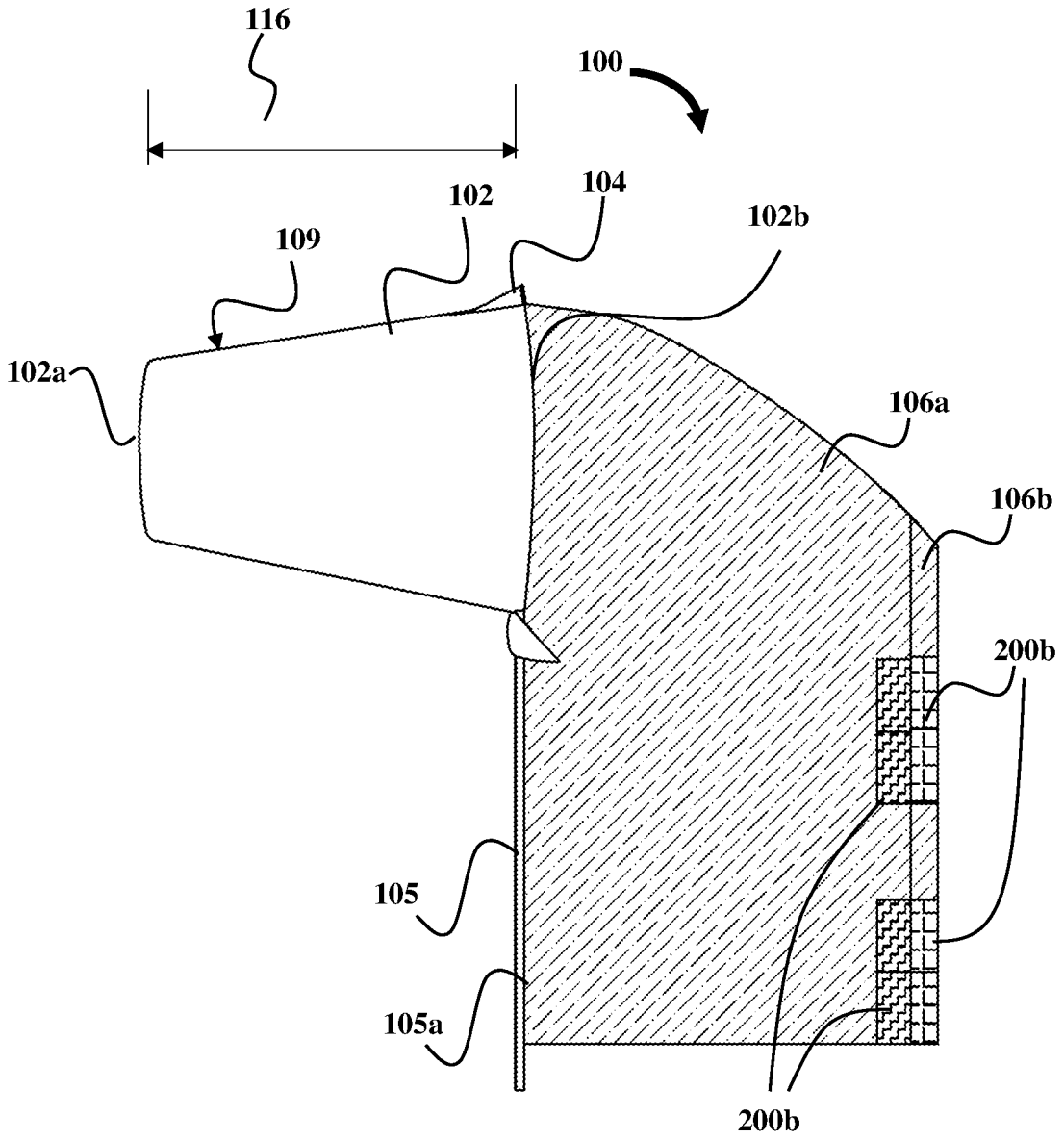
FIG. 1D exemplarily illustrates a right-side view of the weight lifting support shirt.
Figure 1E:
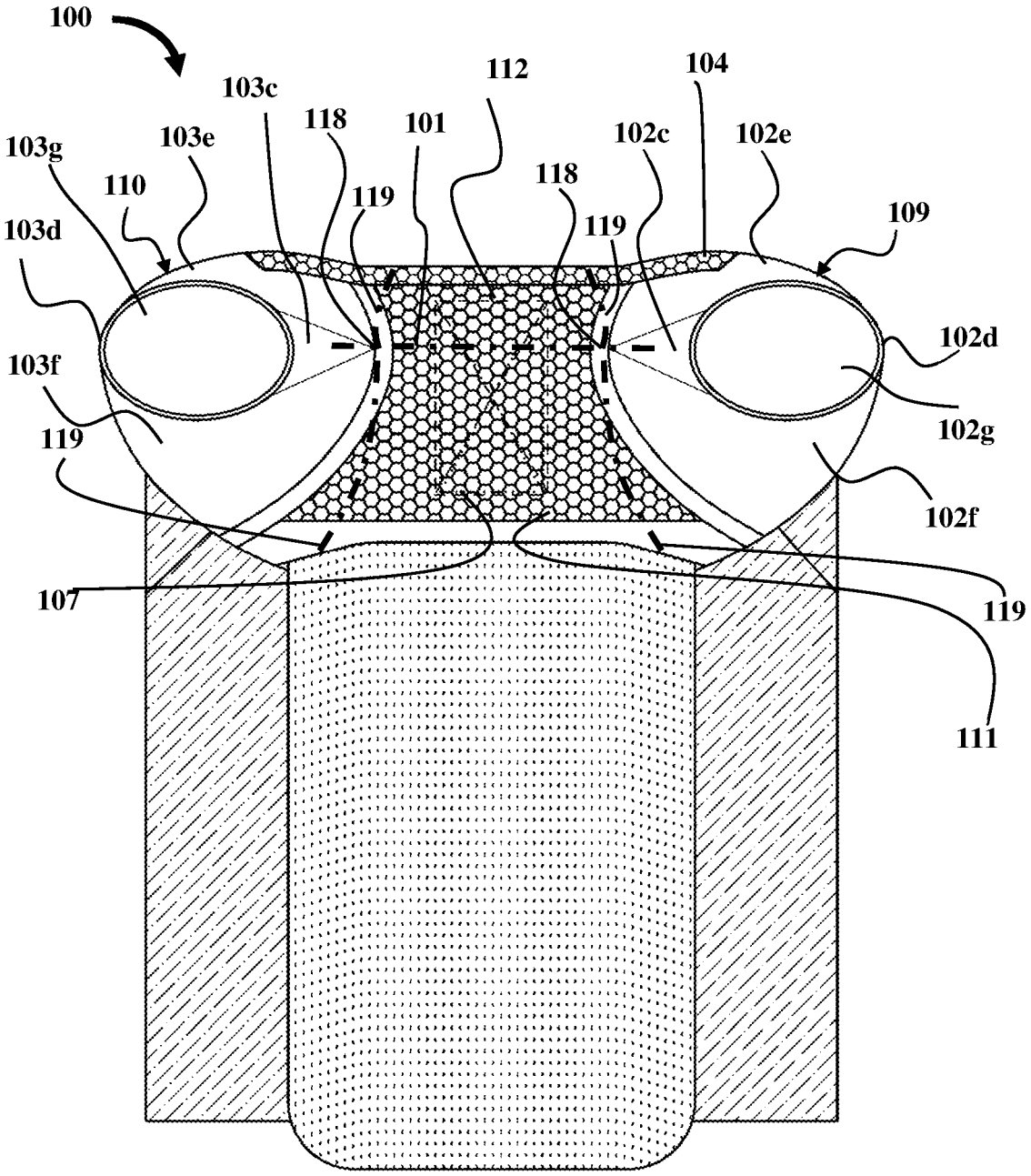
FIG. 1E exemplarily illustrates a front view of the weight lifting support shirt showing a lower elastic section and an upper elastic section.
Figure 1F:
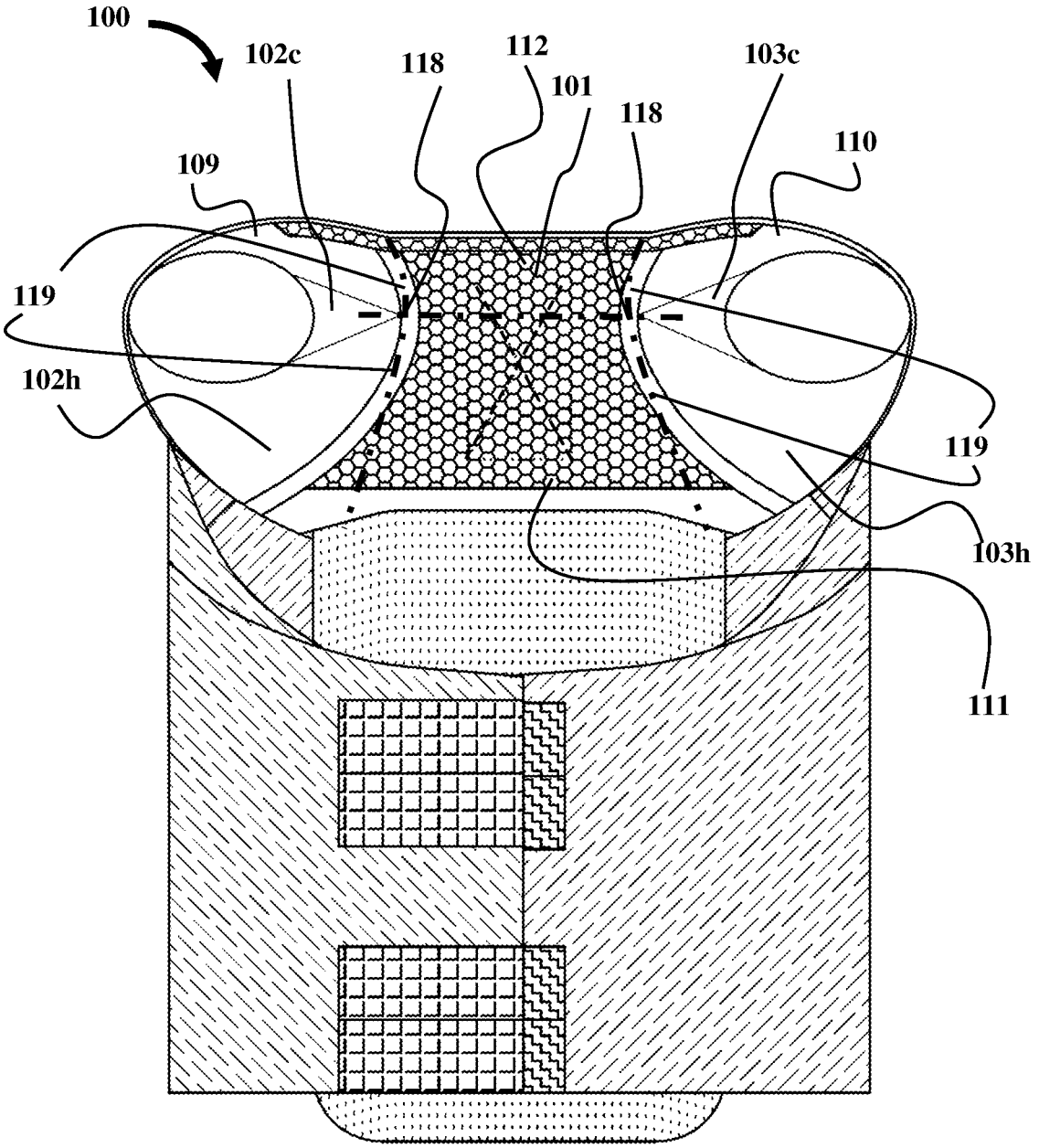
FIG. 1F exemplarily illustrates a rear view of the weight lifting support shirt.

FIG. 1A exemplarily illustrates a front view of a weight lifting support shirt 100. The weight lifting support shirt 100 provides the necessary flexibility to a lifter 700 to allow a proper range of weight lifting motion and depth when working out with a weight 702, for example, a barbell, shown in FIG. 8. FIG. 1B exemplarily illustrates a front view of the weight lifting support shirt 100 worn by the lifter 700 in a standing position. FIG. 1C exemplarily illustrates a left-side view of the weight lifting support shirt 100. FIG. 1D exemplarily illustrates a right-side view of the weight lifting support shirt 100. FIG. 1E exemplarily illustrates a front view of the weight lifting support shirt 100 illustrating a lower elastic section 111 and an upper elastic section 112. FIG. 1F exemplarily illustrates a rear view of the weight lifting support shirt 100.

Figure 2A:
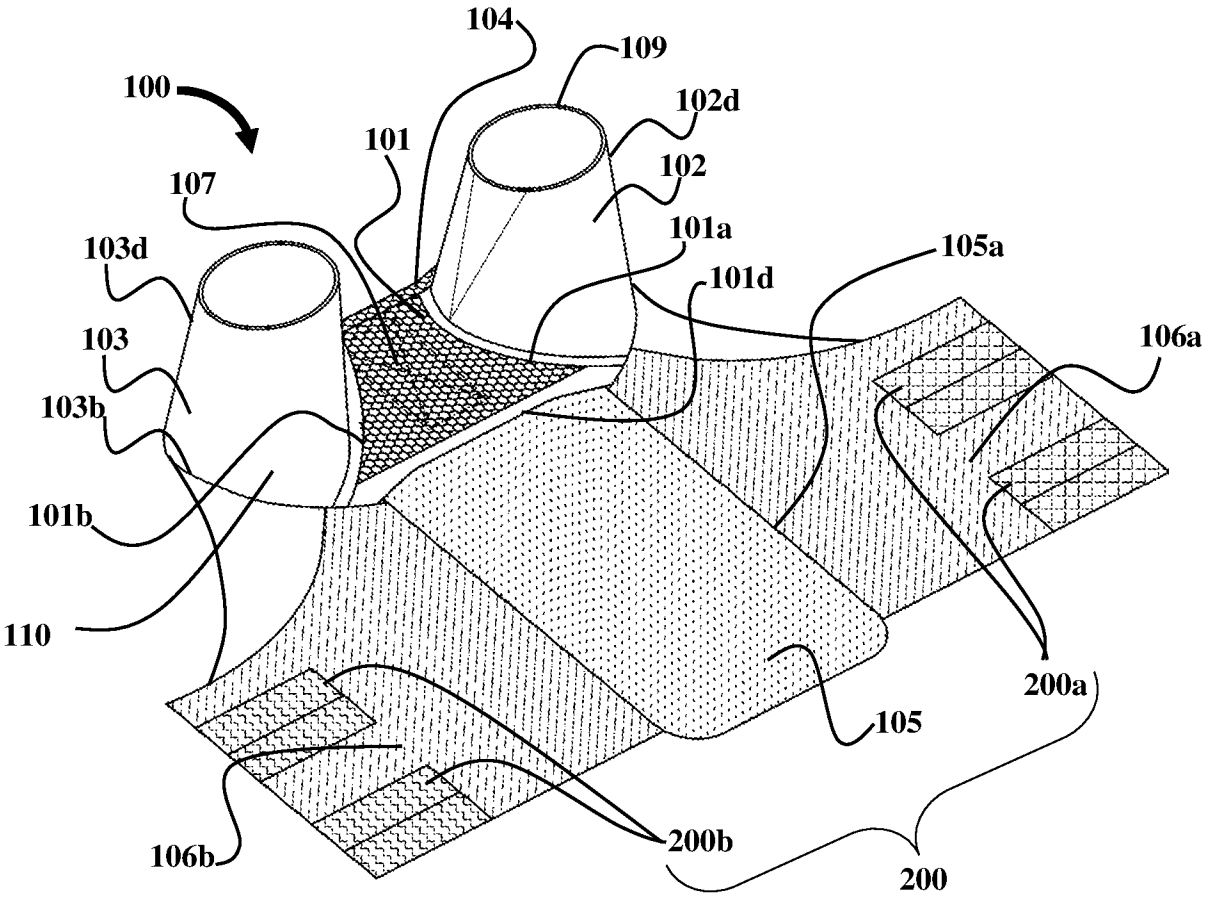
FIG. 2A exemplarily illustrates a front view of the weight lifting support shirt showing a first lateral extension and a second lateral extension, both in their unfastened states.
Figure 2B:
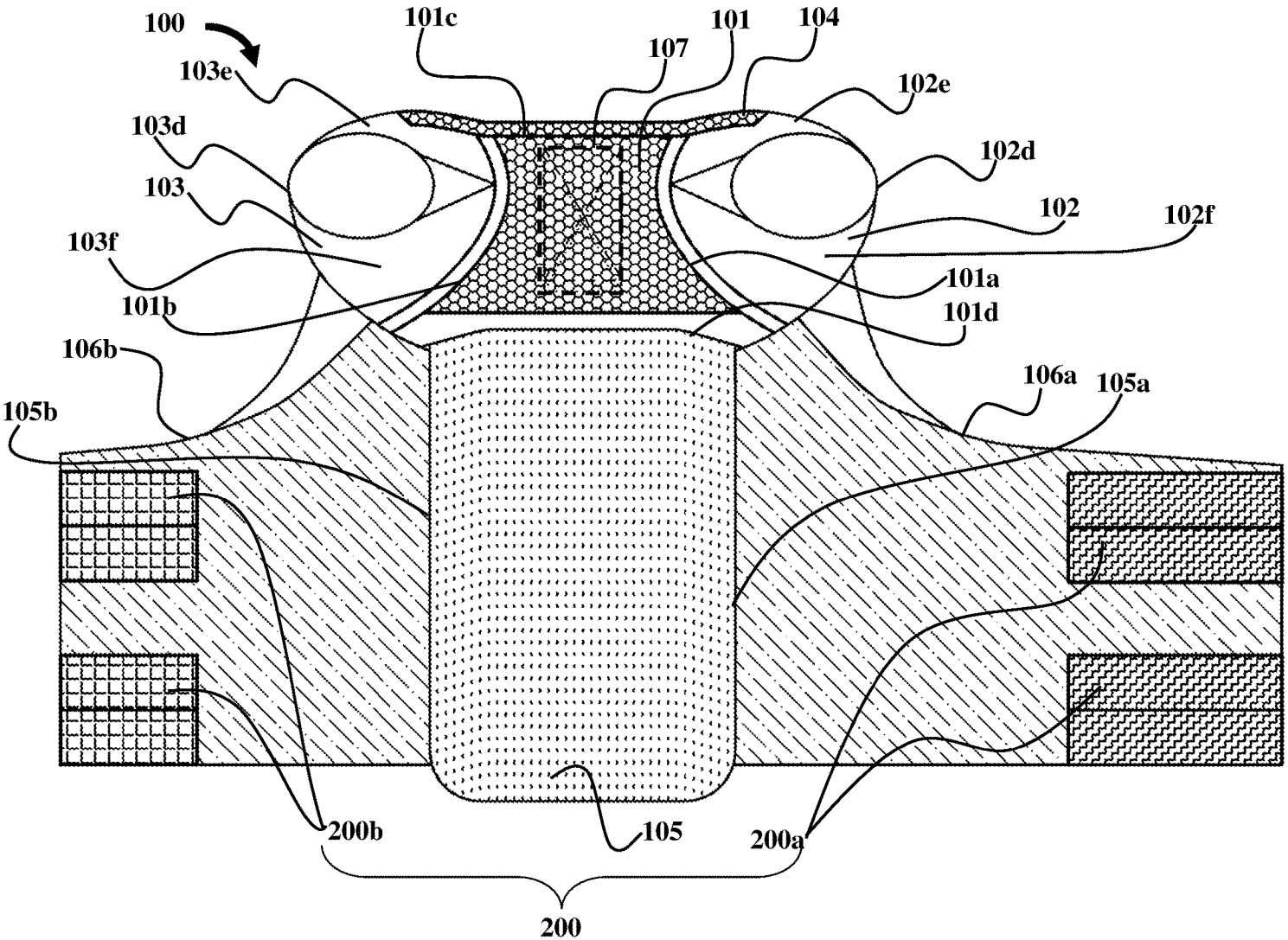
FIG. 2B exemplarily illustrates a front view of the weight lifting support shirt.
Figure 2C:
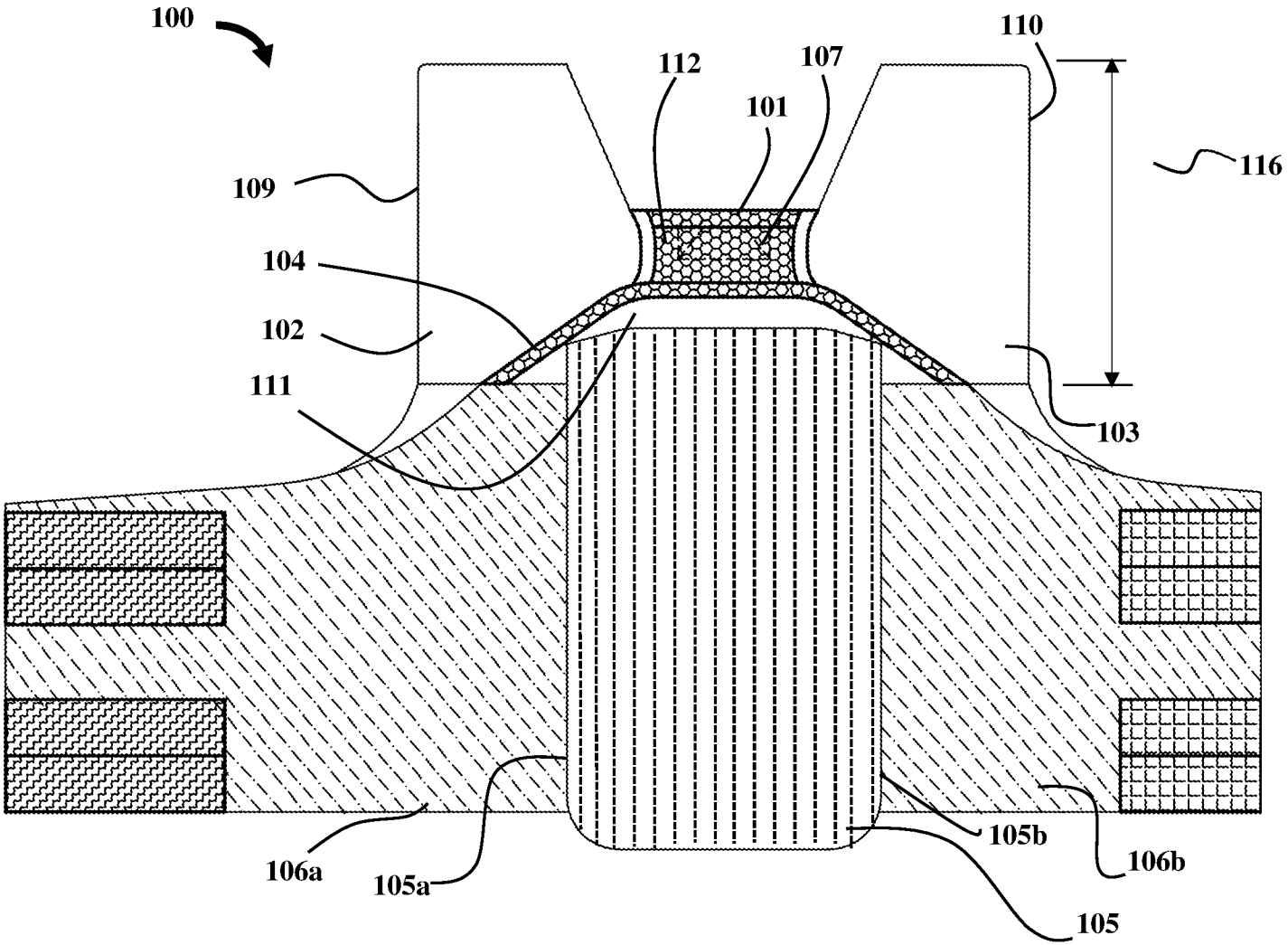
FIG. 2C illustrates a rear view showing the weight lifting support shirt, and sleeves and a chest support portion of the weight lifting support shirt laid flat on a surface.
Figure 3:
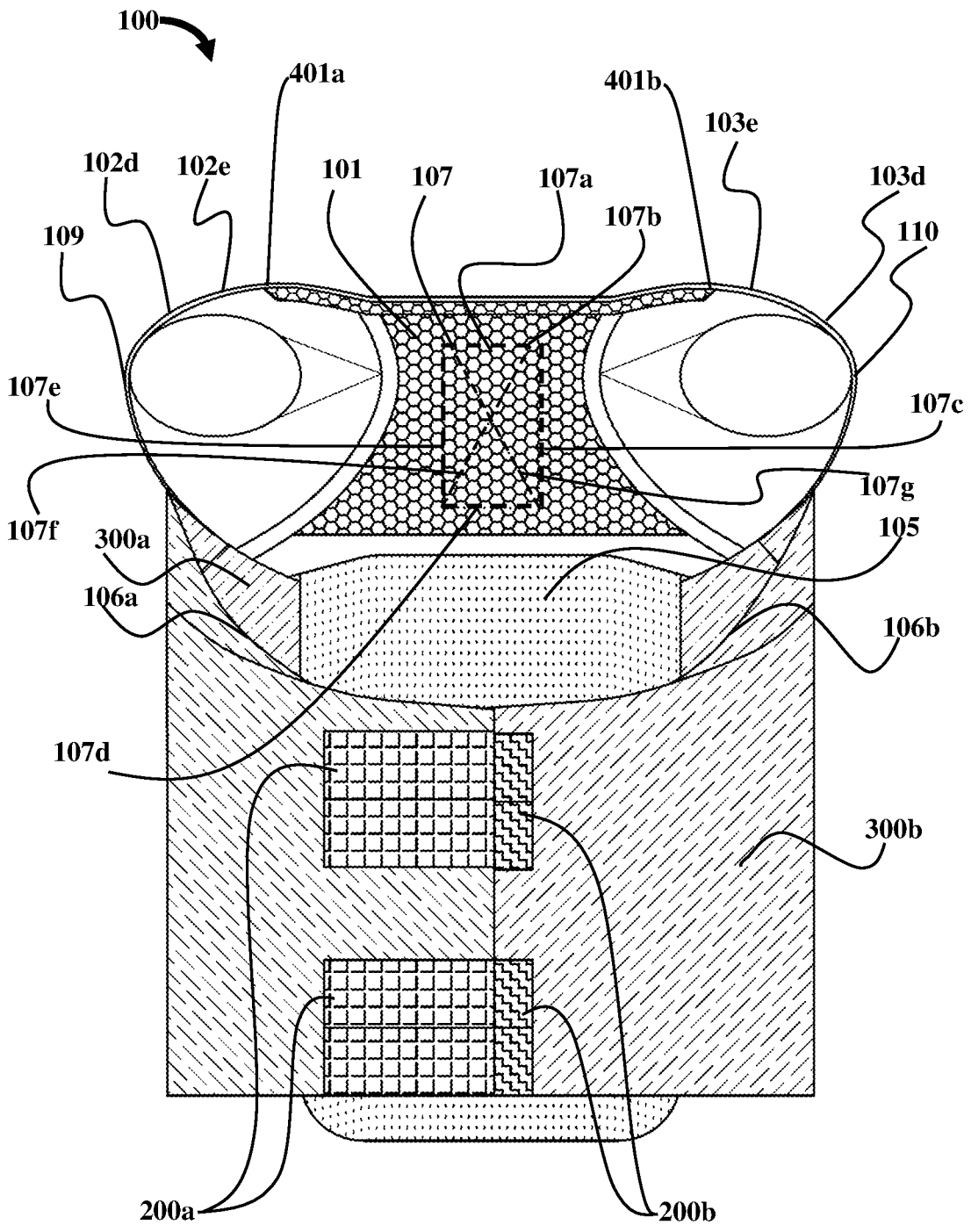
FIG. 3 exemplarily illustrates a rear view of the weight lifting support shirt showing the first lateral extension and the second lateral extension in a fastened state.
Figure 7:
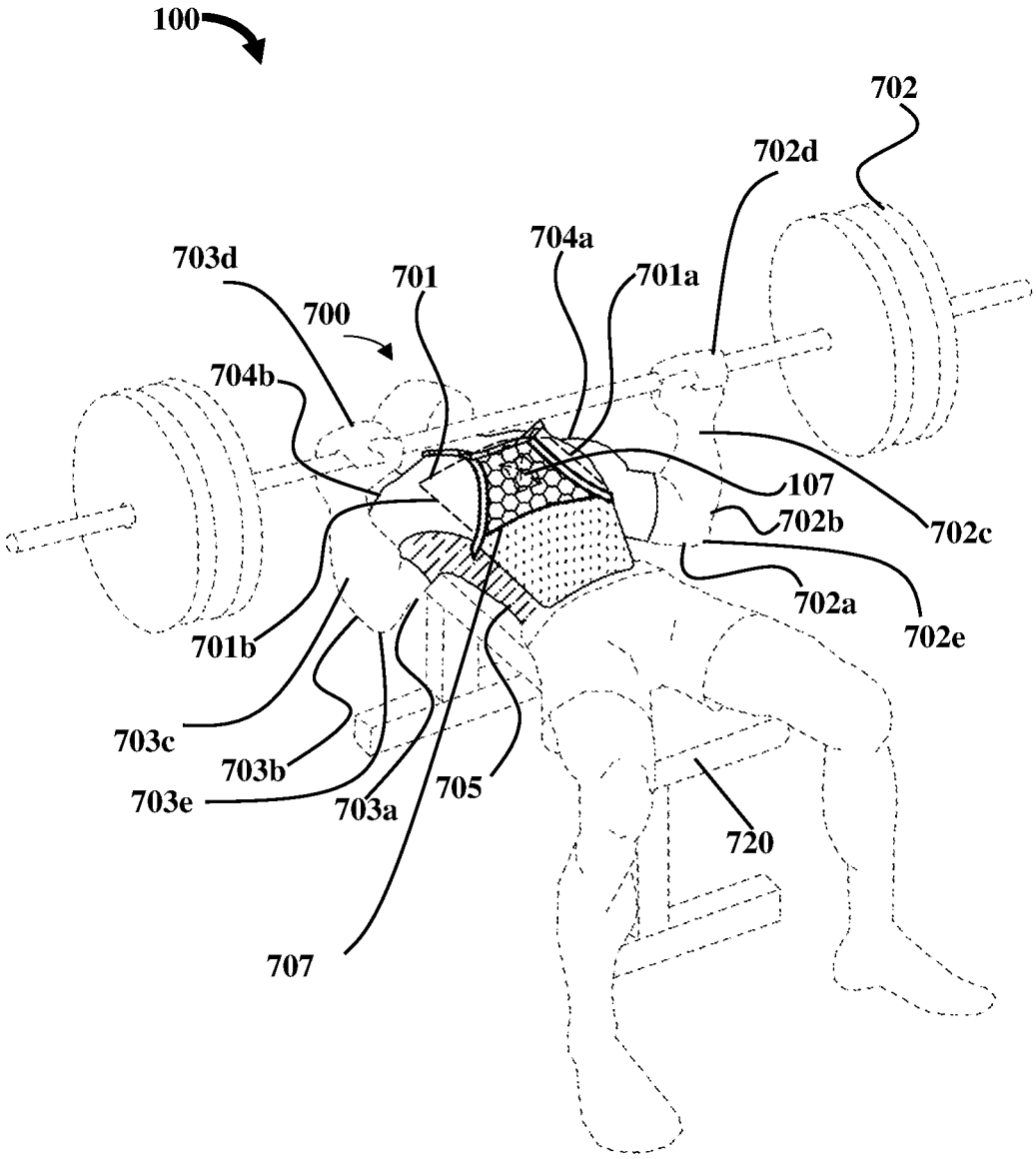
FIG. 7 exemplarily illustrates a front top perspective view of the weight lifting support shirt that is being used by a lifter during a bench press workout.

FIG. 2A exemplarily illustrates a front view of the weight lifting support shirt 100 showing a first lateral extension 106*a* and a second lateral extension 106*b*, both in their unfastened states. FIG. 2B exemplarily illustrates a front view of the weight lifting support shirt 100. FIG. 2C illustrates a rear view showing the weight lifting support shirt 100, and sleeves 109 and 110 and a chest support portion 101 of the weight lifting support shirt 100 laid flat on a surface. FIG. 3 exemplarily illustrates a rear view of the weight lifting support shirt 100. The weight lifting support shirt 100 is a wearable device that provides the weight lifter 700 flexibility of movement during a barbell exercise, for example, a bench press workout as shown in FIG. 7, while allowing the load and energy of the weight 702 to be transferred to the center of the weight lifting support shirt 100, and maximizing transfer of the load and energy of the weight 702 from the shoulders to the triceps, pectoral, and latissimus regions of the lifter 700, to reduce strain on the rotator cuffs and to stabilize the shoulder and shoulder girdle of the lifter 700. Furthermore, the weight lifting support shirt 100 provides support to the lifter 700 during a variety of workouts.

Figure 8:
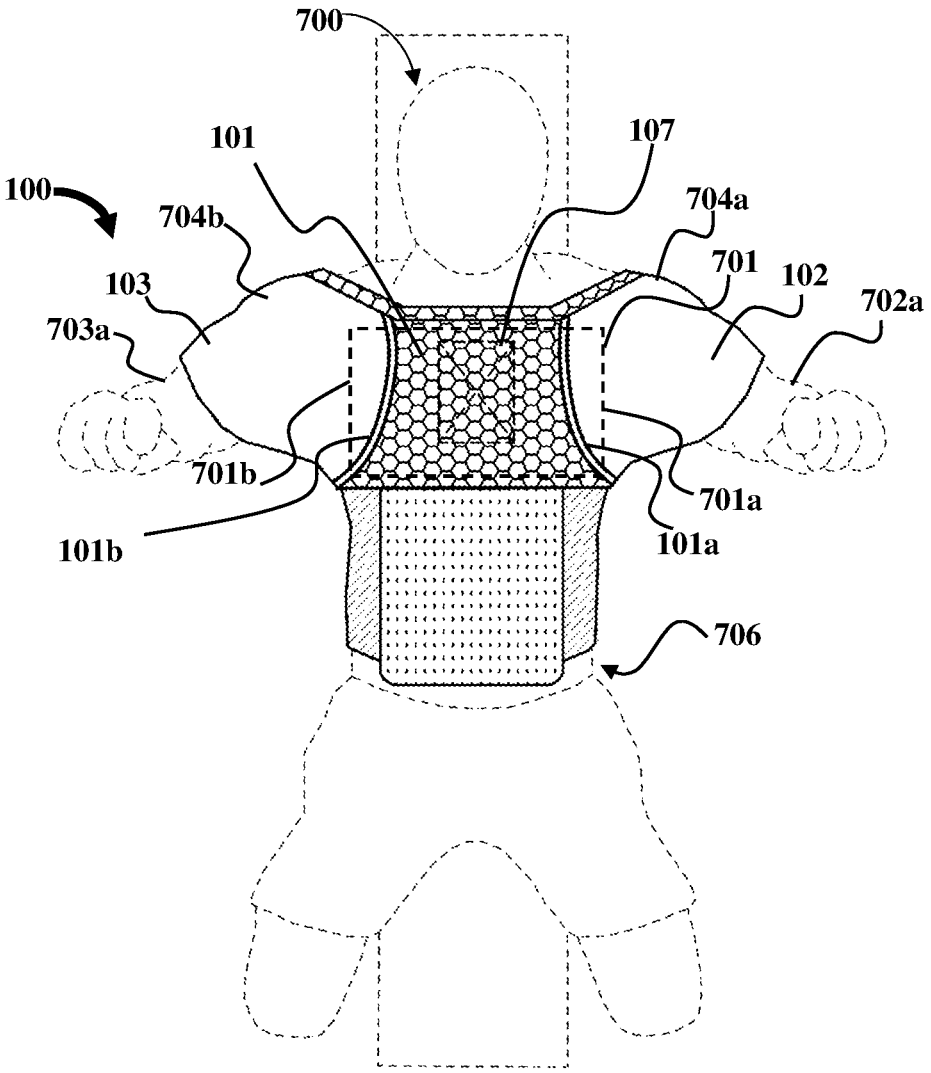
FIG. 8 exemplarily illustrates a top view of the weight lifting support shirt that is being used by the lifter during a bench press workout.

As illustrated in FIGS. 1A-1B, the weight lifting support shirt 100 comprises the chest support portion 101, a first arm support portion 102, a second arm support portion 103, a neck relief portion 104, a torso support portion 105, a first lateral extension 106*a* and a second lateral extension 106*b*. The chest support portion 101 is configured to extend across a chest portion 701, illustrated in FIGS. 7 and 8, of the lifter 700 from a first end 701*a* to a second end 701*b* of the chest portion 701. The first arm support portion 102 extends from a first end 101*a* of the chest support portion 101, and the second arm support portion 103 extends from a second end 101*b* of the chest support portion 101. As shown in FIG. 8, the first end 101*a* of the chest support portion 101 extends from a portion of the of the chest support portion 101 that is proximal to the first end 701*a* of the chest portion 701, and the second end 101*b* of the chest support portion 101 extends from a portion of the of the chest support portion 101 that is proximal to the second end 701*b* of the chest portion 701. In an embodiment, the first arm support portion 102 and the second arm support portion 103 are attached to the first end 101*a* and the second end 101*b* of the chest support portion 101, respectively, by stitching using, for example, an elastic thread. Bands 113 shown in FIG. 1A represent seams that represent the joining of the garment sections of the first arm support portion 102 and the first end 101*a* of the chest support portion 101, and the garment sections of the second arm support portion 103 and the second end 101*b* of the chest support portion 101. The first and second arm support portions 102 and 103 are configured to accommodate and support a first upper arm 702*a* and a second upper arm 703*a* of the lifter 700, respectively.

The neck relief portion 104 is attached to an upper boundary 101*c* of the chest support portion 101, as shown in FIG. 1A. The neck relief portion 104 connects the first arm support portion 102 to the second arm support portion 103. In an embodiment, the neck relief portion 104 comprises an elastic material. The elastic material of the neck relief portion 104 stretches to store energy when a weight 702, for example, the barbell, is lowered by the lifter 700. The elastic material of the neck relief portion 104 releases the stored energy and returns to an unstretched state of the elastic material when the weight 702 is raised by the lifter 700 while performing the workout with the weight 702. The energy stored by the stretched elastic material of the neck relief portion 104 allows the lifter 700 to press the weight 702, away from the lifter's 700 body 706 when the weight 702 is raised by the lifter 700.

In an embodiment, the neck relief portion 104 and the chest support portion 101 are made of the same material, for example, nylon, poly-based, elastic, or rubber material. In an embodiment, the chest support portion 101 is made of a synthetic material. The neck relief portion 104 and the chest support portion 101 are configured to store and release energy while performing the workout with the weight 702, for example, the barbell. The chest support portion 101 extends towards a collar region 108 of the weight lifting support shirt 100 to define the neck relief portion 104. The torso support portion 105 is in communication with and extends below the chest support portion 101. In an embodiment, the torso support portion 105 extends below a lower boundary 101*d* of the chest support portion 101.

Figure 9:
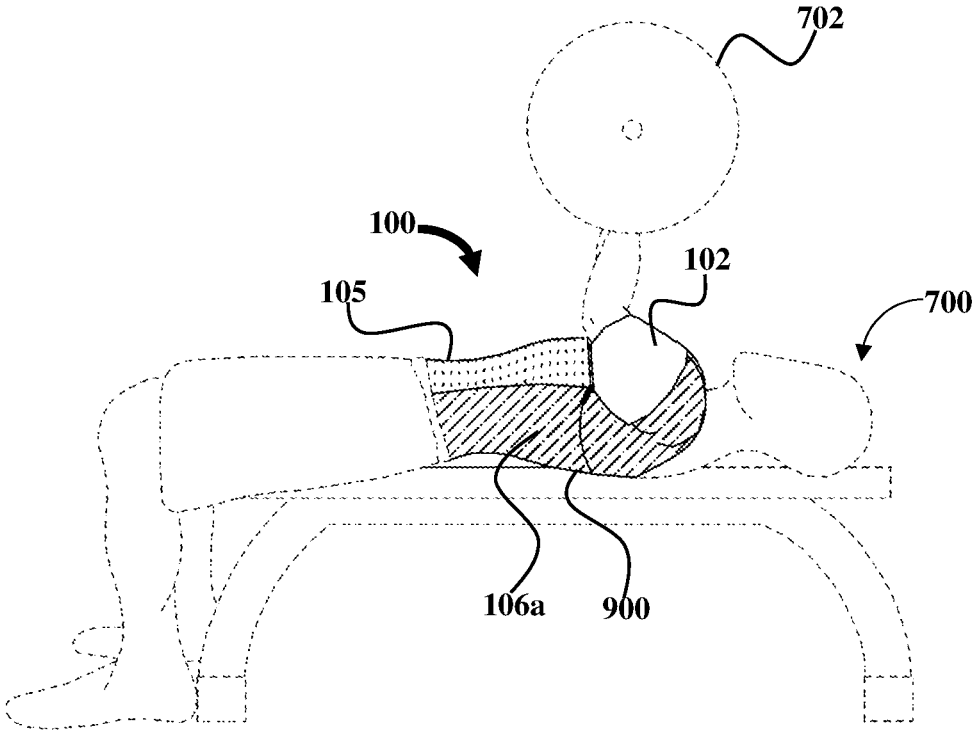
FIG. 9 illustrates a right-side view of the weight lifting support shirt worn by the lifter during a bench press workout.

As illustrated in FIGS. 1A, 1B, 2A, and 2B, the first lateral extension 106*a* extends from the first arm support portion 102 and a first lateral side 105*a* of the torso support portion 105. The second lateral extension 106*b* extends from the second arm support portion 103 and a second lateral side 105*b* of the torso support portion 105. The first lateral extension 106*a* is configured to wrap around a first shoulder 704*a* and a back 900 of the lifter 700, as shown in FIG. 9. The second lateral extension 106*b* is configured to wrap around a second shoulder 704*b* and the back 900 of the lifter 700.

The weight lifting support shirt 100 disclosed herein stores energy when the lifter 700 lowers a weight 702 and releases the energy when the lifter 700 lifts the weight 702. The release of energy assists the lifter 700 in lifting the weight 702. The configuration and the mechanical advantage of the weight lifting support shirt 100 disclosed herein are novel. As illustrated in FIGS. 1C, 1D, 4 and 5 the first arm support portion 102 comprises a sleeve 109 and the second arm support portion 103 comprises a sleeve 110. The sleeve 109 is configured to enclose the first upper arm 702*a* of the lifter 700 and the sleeve 110 is configured to enclose the second upper arm 703*a* of the lifter 700 as illustrated in FIGS. 7 and 8. The pair of sleeves 109 and 110 are in the shape of a truncated cone with the truncated end corresponding with an elbow end (102*a*, 103*a*) of the sleeves 102 and 103, respectively, as shown in FIGS. 1C, 1D, 2A, 4, 5, and 6. The conical, truncated pair of sleeves 102 and 103 illustrated in FIG. 1B of the weight lifting support shirt 100 are configured to accommodate and support the lifter's 700 shoulder and the weight lifter's 700 deltoid, bicep and triceps muscles.

As illustrated in FIGS. 1C and 1D, the sleeve 109 or 110 of the pair of sleeves 109 and 110 extends towards the elbow of the lifter 700. Each of the sleeves (109, 110) are elastic and resilient. Furthermore, each sleeve (109, 110) defines an elbow end (102*a*, 103*a*) and a shoulder end (102*b*, 103*b*), as shown in FIGS. 1C, 1D, 4 and 5. Moreover, each sleeve (109, 110) defines a sleeve length 116 between the shoulder end (102*b*, 103*b*) and the elbow end (102*a*, 103*a*). Furthermore, each sleeve (109, 110) defines an upper side (102*e*, 103*e*), a lower side (102*f*, 103*f*), an inner side (102*c*, 103*c*), and an outer side (102*d*, 103*d*), as shown in FIGS. 1E, 1C, 1D, 4 and 5. As illustrated in FIGS. 1E and 7, the upper side (102*e*, 103*e*), the lower side (102*f*, 103*f*), the inner side (102*c*, 103*c*), and the outer side (102*d*, 103*d*) of each sleeve (109, 110) is configured to enclose the corresponding upper arm (702*a*, 703*a*) of the lifter 700. Each of the sleeves (109, 110) further comprise an outer sleeve opening (102*g*, 103*g*), as shown in FIG. 1E for allowing the forearm (702*c*, 703*c*) and hand (702*d*, 703*d*) of the lifter 702 to pass through the outer sleeve opening (102*g*, 103*g*) when the weight lifting support shirt 100 is worn by the lifter 700. The inner side (102*c*, 103*c*) of each sleeve (109, 110) defines an inner sleeve opening (102*h*, 103*h*), as shown in FIG. 1F, that extends about two-thirds of the sleeve length 116 from the shoulder end (102*b*, 103*b*) to a sleeve closure location 118, where the inner sleeve opening (102*h*, 103*h*) defines opening edges 119. The sleeve closure location 118 is the location on the chest support portion 101 where the inner sides (102*c*, 103*c*) of the sleeves (109, 110) is closed, as shown in FIGS. 1E and 1F.

As illustrated in FIGS. 1E and 1F, the chest support portion 101 of the weight lifting support shirt 100 comprises the lower elastic section 111 and the upper elastic section 112. The lower elastic section 111 is resilient and is attached to and extends between the opening edges 119 of the inner side (102*c*, 103*c*) of the sleeves (109, 110) from the shoulder end (102*b*, 103*b*) of each sleeve (109, 110) to the sleeve closure location 118. Dash-dot-dash lines illustrated in the chest support portion 101 FIGS. 1E and 1F do not represent stitching lines. The dash-dot-dash lines represent boundaries between various sections of the weight lifting support shirt 100. For example, the horizontal dash-dot-dash line represents a separation between the lower elastic section 111 and the upper elastic section 112, whereas the substantially vertical dash-dot-dash lines represent the opening edges 119 of the inner side (102*c*, 103*c*) of the sleeves (109, 110).

As illustrated in FIGS. 1E and 1F, the upper elastic section 112 is resilient and is a contiguous part to the lower elastic section 111. Furthermore, the upper elastic section 112 extends between the opening edges 119 of the inner side (102*c*, 103*c*) of the sleeves (109, 110) from the sleeve closure location 118 of the sleeve 109 to the closure location 118 of the sleeve 110. The upper elastic section 112 is closer to the user's face than the lower elastic section 111 when the lifter 700 is wearing the weight lifting support shirt 100. As illustrated in FIG. 2C, the combination of the lower and upper elastic sections (111, 112) of the chest support portion 101 resiliently connects the sleeves (109, 110) along generally about half of the sleeve length 116.

Figure 11:
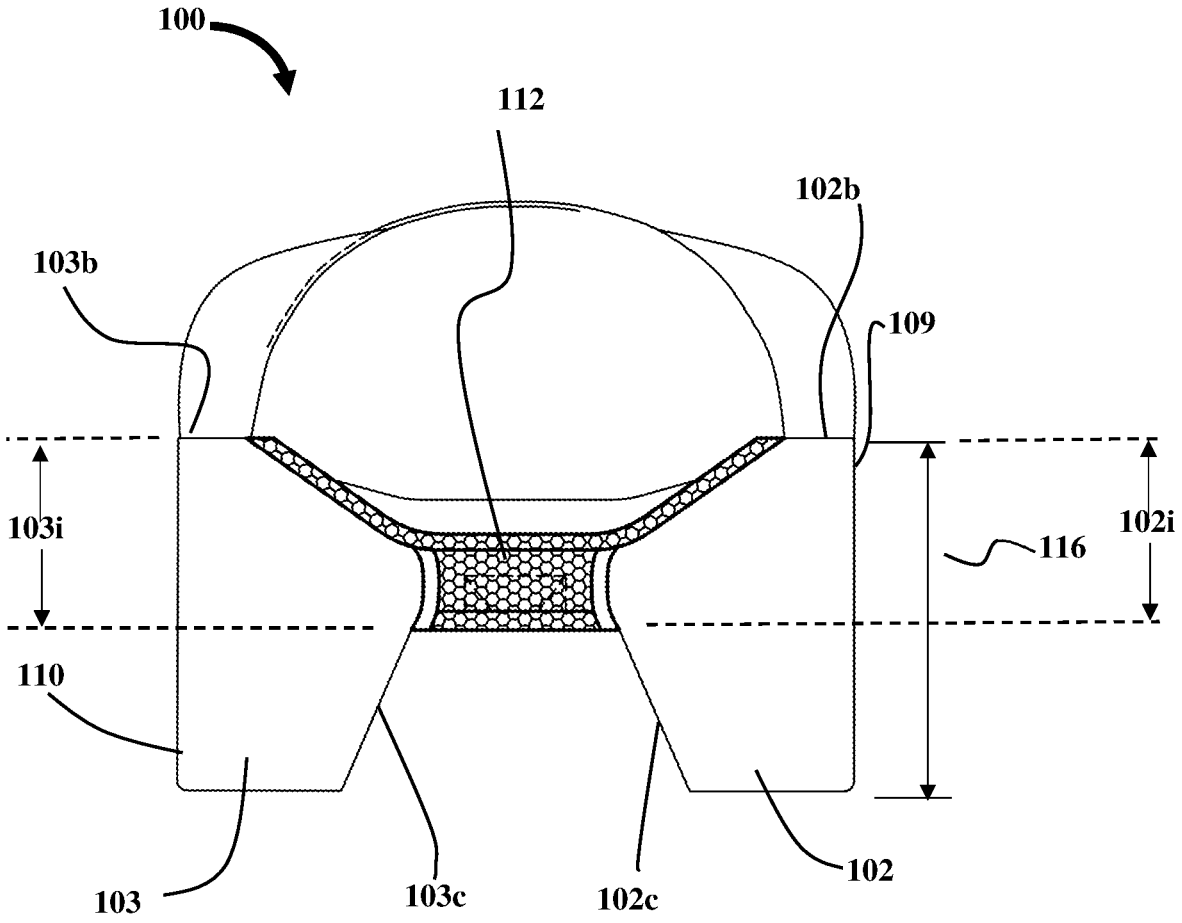
FIG. 11 illustrates a top view of the weight lifting support shirt when the lifter is seated.

As illustrated in FIGS. 1E and 11, the outer side (102*d*, 103*d*), the upper side (102*e*, 103*e*), the lower side (102*f*, 103*f*), and the inner side (102*c*, 103*c*) of the sleeves (109, 110) enclose the corresponding portions of the lifter's 700 upper arms 702*a* or 703*a*. As shown in FIGS. 1F and 11, approximately half of the inner side (102*c*, 103*c*) of each sleeve (109, 110) at the shoulder end (102*b*, 103*b*) is open, to receive the lifter's 700 upper arms 702*a* or 703*a*, and is not enclosed. The open portion (102*i*, 103*i*) of each sleeve (109, 110) operatively connects the upper elastic section 112 with the lower elastic section 111. As illustrated in FIG. 1E, the lower elastic section 111 extends adjacent to the torso support portion 105, and approximately between the opening edge 119 of the inner side 102*c* from the sleeve closure location 118 of the sleeve 109 to the opening edge 119 of the inner side 103*c* from the sleeve closure location 118 of the sleeve 110. The upper elastic section 112 extends adjacent to the neck relief portion 104, and approximately between the opening edge 119 of the inner side 102*c* from the sleeve closure location 118 of the sleeve 109 to the opening edge 119 of the inner side 103*c* from the sleeve closure location 118 of the sleeve 110.

FIG. 3 exemplarily illustrates a rear view of the weight lifting support shirt 100 showing the first lateral extension 106*a* and the second lateral extension 106*b* in a fastened state. The first lateral extension 106*a* is attached to a point 401*a* where the neck relief portion 104 terminates at the upper side 102*e* of the sleeve 109. The second lateral extension 106*b* is attached to a point 401*b* where the neck relief portion 104 terminates at the upper side 103*e* of the sleeve 110, as illustrated in FIGS. 3, 4, 5 and 6. In an embodiment, the neck relief portion 104 is made of an elastic material. The neck relief portion 104 is configured to store energy when the lifter 700 lowers a weight 702, illustrated in FIGS. 7 and 8, and stretches the elastic material of the neck relief portion 104, the energy received is conserved until the lifter 700 presses the weight 702 away from the body 706.

Figure 4:
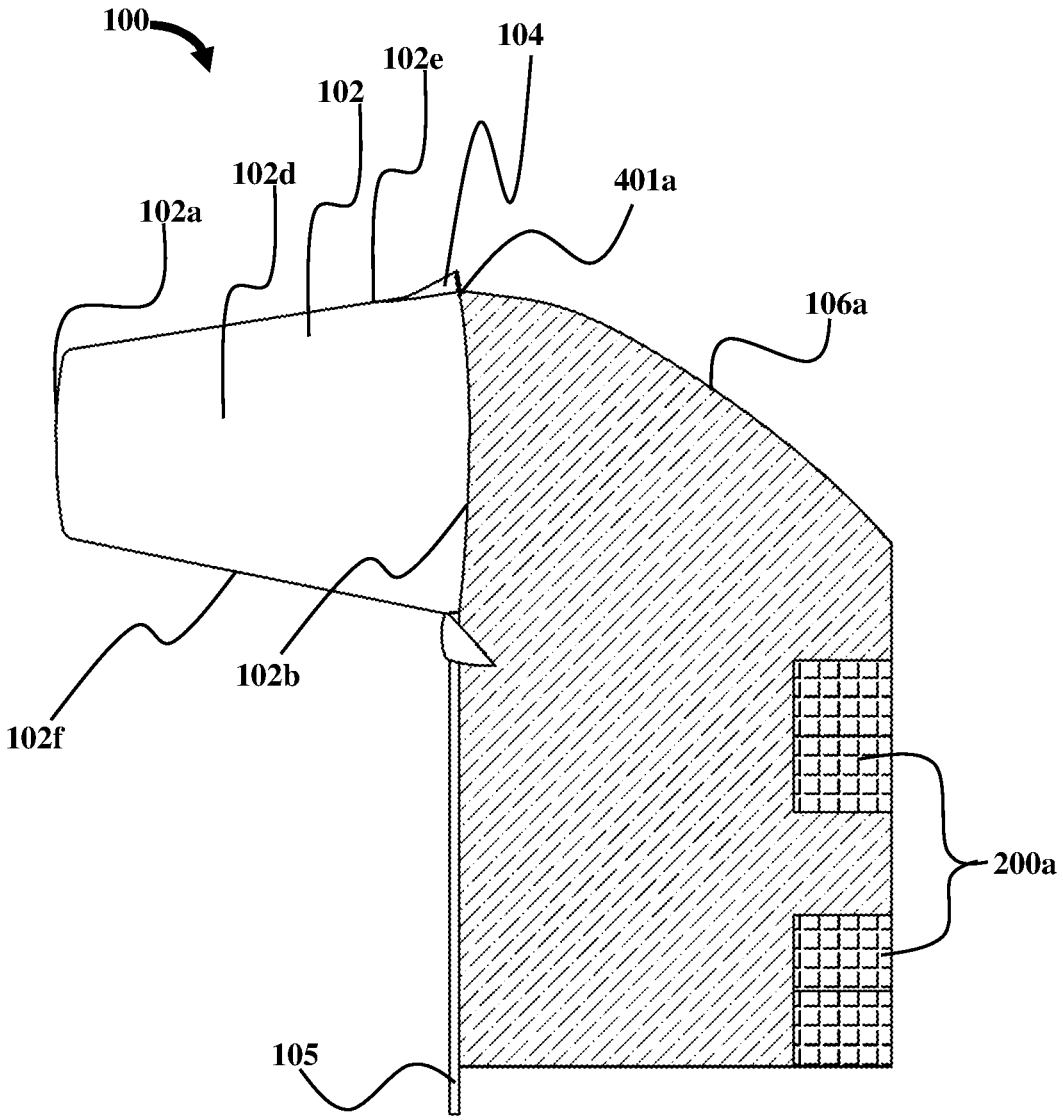
FIG. 4 exemplarily illustrates a right-side view of the weight lifting support shirt.
Figure 5:
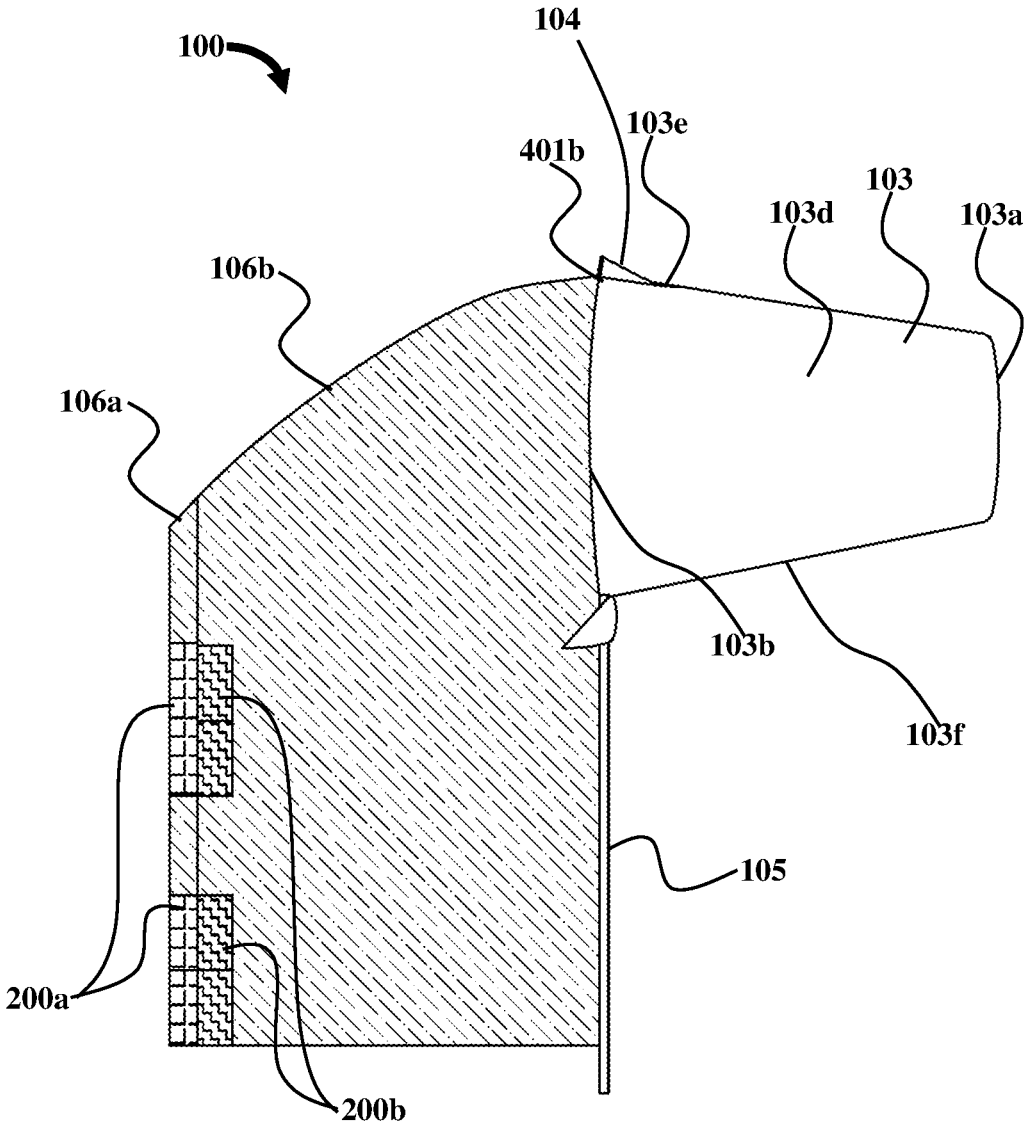
FIG. 5 exemplarily illustrates a left-side view of the weight lifting support shirt.

FIG. 4 exemplarily illustrates a right-side view of the weight lifting support shirt 100. FIG. 5 exemplarily illustrates a left-side view of the weight lifting support shirt 100. The open portion (102*i*, 103*i*) of each sleeve (109, 110), shown in FIG. 11, facilitates operation of the lower elastic section 111 and the upper elastic section 112, as follows. In use, the lower elastic section 111 generally faces the lifter's 700 feet and away from the lifter's 700 face. In an embodiment, the upper elastic section 112 is joined to the lower elastic section 111 and extends between the opening edges 119 of the sleeve inner sides 102*c* and 103*c* for approximately one-fourth of the sleeve length 116 of the sleeve 110 from the sleeve closure location 118 toward the neck relief portion 104, as shown in FIGS. 1E and 11. In an embodiment, the horizontal dash-dot-dash line in FIGS. 1E and 1F in the chest support portion 101 represents a line, for example, stitching line, along which the upper elastic section 112 is joined to the lower elastic section 111. The upper elastic section 112 faces the lifter's 700 face in use and way from the lifter's 700 feet. As illustrated in FIG. 7, to use the weight lifting support shirt 100, a user 700 extends the user's 700 forearms 702*b* and 703*b* through the sleeves 109 and 110 with the lower and upper elastic sections 111 and 112 in front of the user 700. While lying on the user's 700 back 900 on a weight bench 720, the user 700 lifts the weighted barbell 702 from pegs supporting the weighted barbell 702. As the user 700 lowers the weighted barbell 702, the lower and upper elastic sections 111 and 112 encounter the user's chest 701 and upper abdomen 707. As the user 700 continues to lower the barbell 702, as shown in FIG. 7, the lower and upper elastic sections 111 and 112 stretch across the user's chest portion 701 and upper abdomen 707, applying a downward force to the user's chest portion 701 and abdomen 707 and a corresponding upward force to the user's upper arms 702*a* and 703*a*. The upward force is distributed along the user's upper arms 702*a* and 703*a* from the shoulder portion 108 to approximately two-thirds of the length of the user's upper arms 702*a* and 703*a* towards the elbow 702*e* and 703*e*. A proportionally greater amount of the upward force is applied proximal to the user's elbows 702*e* and 703*e* than is applied proximal to the user's shoulder portions, i.e., the first and second shoulders 704*a* or 704*b*.

During a bench press, the lifter's upper arm bone between the elbow (702*e*, 703*e*) and the shoulder (704*a*, 704*b*), known as the humerus is effectively a lever pivoting about the lifter's shoulder joint. The weighted barbell 702 presses downward on the humerus at the end farthest from the shoulder portion (704*a*, 704*b*). The prior art bench shirts apply the upward force on the humerus proximal to the shoulder portion (704*a*, 704*b*), resulting in application of a greater force and consequently greater strain on the lifter's shoulder (704*a*, 704*b*). Because the upward force of the weight lifting support shirt 100 when the weight is raised is applied closer to the elbow (702*e*, 703*e*) compared to a prior art bench shirt, the weight lifting support shirt 100 disclosed herein reduces the force exerted on the lifter's shoulder (704*a*, 704*b*).

The shoulder ends 102*b* and 103*b* of the sleeves 109 and 110, drawn or pulled by the lower and upper elastic sections 111 and 112, constrain the user's shoulder portions 704*a* and 704*b* and reduce the possibility of injury to the user's shoulder portions 704*a* and 704*b*.

As illustrated in FIGS. 1A, 1B, 2A, 2B, 6, 7, and 8, the weight lifting support shirt 100 further comprises a grid plate 107 disposed substantially at a center of the chest support portion 101. The grid plate 107 is configured to resist stretching of the material of the chest support portion 101 of the weight lifting support shirt 100 and to store energy during the descent of the weight 702, and to rebound the stored energy into the chest portion 701 and the upper arms 702*a* and 703*a* of the lifter 700 when the weight 702 is raised. In an embodiment, the grid plate 107 is made of the same material as the chest support portion 101. In an embodiment, the grid plate 107 is a flat, semi-rigid plate of from about 1/16 inch to about 1/4 inch of a synthetic material, for example, a polyester. In an embodiment the grid plate 107 comprises multiple layers of a synthetic material used to construct the chest support portion 101. The multiple layers of synthetic material are collated and/or affixed to one another to form the grid plate 107.

In an embodiment the grid plate 107 additionally or alternatively comprises a figure eight stitching 107*a* that is configured to further concentrate load and energy towards the center of the weight lifting support shirt 100 when the weight 702 illustrated in FIG. 7 is lowered by the lifter 700 during the workout. In an embodiment, the figure eight stitching 107*a* is sewn into the chest support portion 101 using one of a non-stretchable thread and a stretch resistant thread. For example, the figure eight stitching 107*a* is sewn using one of a nylon thread, a polyester thread, etc. The figure eight stitching 107*a* is stitched in the shape of a four-sided parallelogram comprising four sides 107*b*, 107*c*, 107*d*, and 107*e*, and two diagonals 107*f* and 107*g*, as shown in FIG. 3. The figure eight stitching 107*a* reduces stretching of the elastic, resilient material of the chest support portion 101 in the area of the grid plate 107 bound by the four-sided parallelogram formed by the figure eight stitching 107*a* when the weight 702 is lowered by the lifter.

Figure 6:
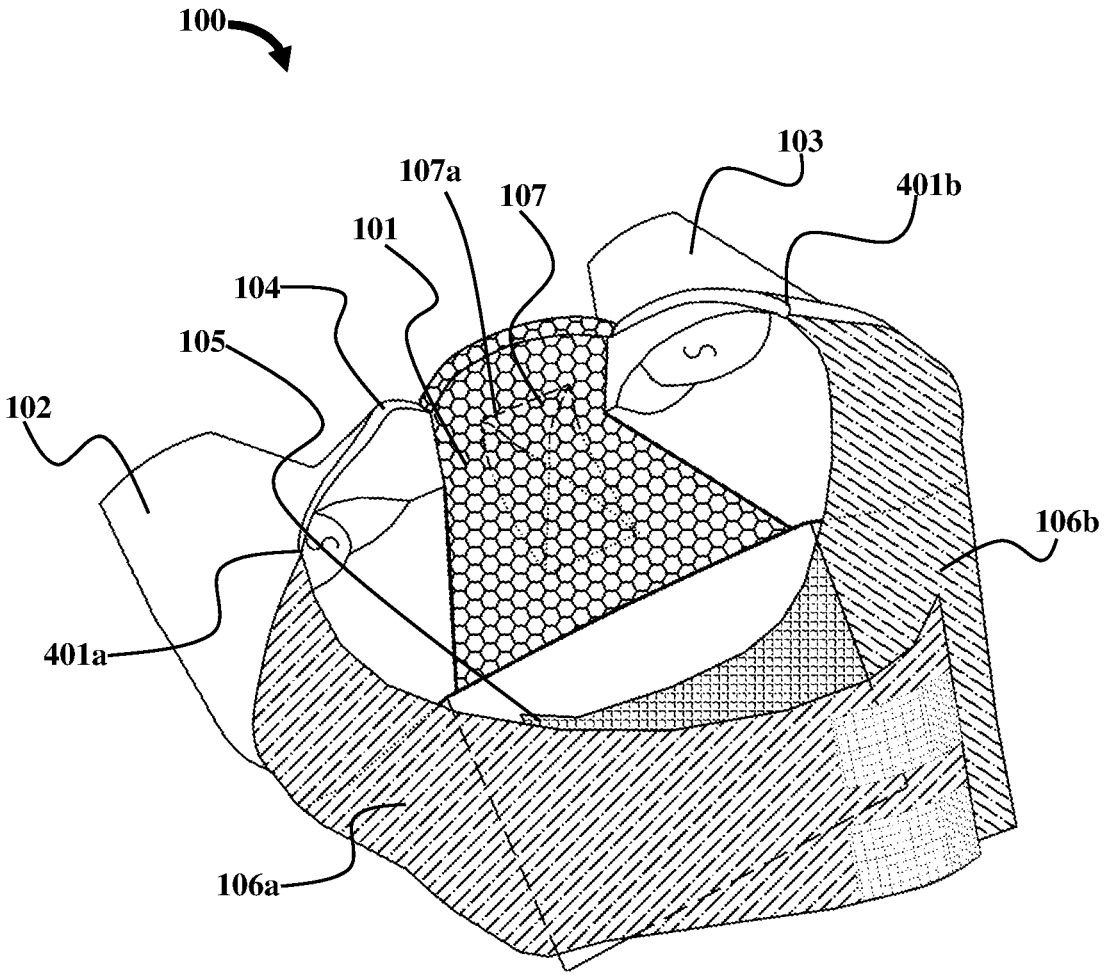
FIG. 6 illustrates a rear top perspective view of the weight lifting support shirt.

As illustrated in FIGS. 2A-5, the first lateral extension 106*a* comprises a loop component 200*a* of a hook and loop fastener 200 attached to a lower surface 300*a* of the first lateral extension 106*a*. The second lateral extension comprises a hook component 200*b* of the hook and loop fastener 200 attached to an upper surface 300*b* of the second lateral extension 106*b*. The torso support portion 105, the first lateral extension 106*a*, and the second lateral extension 106*b* are fastened to the torso 705 of the lifter 700, shown in FIG. 7, using the hook and loop fastener 200. In an embodiment, the first lateral extension 106*a* is longer than the second lateral extension 106*b*, as shown in FIGS. 2A-2C. The first lateral extension 106*a* is configured to overlap the second lateral extension 106*b* when the weight lifting support shirt 100 is worn by the lifter 700, as shown in FIGS. 3, 5 and 6. In an embodiment, the hook component 200*b* of the hook and loop fastener 200 comprises two double width fabric strips, each comprising small hooks with hook ends. The loop component 200*a* of the hook and loop fastener 200 comprises two double width fabric strips, each comprising small loops with loop ends. The hook and loop fastener 200 is, for example, VELCRO® manufactured by VELCRO™ BVBA of United Kingdom.

As illustrated in FIGS. 1B and 7, to wear the weight lifting support shirt 100, the lifter 700 inserts his forearms 702*b* and 703*b* into the first arm support portion 102 and the second arm support portion 103, and draws together the first lateral extension 106*a* and the second lateral extension 106*b* behind the torso of the lifter 700 to align the first lateral extension 106*a* and the second lateral extension 106*b*. Then, the first lateral extension 106*a* and/or the second lateral extension 106*b* are pulled towards each other to the desired level of tightness over the user's torso. The hook component 200*b* and loop component 200*a* on the second lateral extension 106*a* and the first lateral extension 106*b*, respectively, are attached to each other to fasten the weight lifting support shirt 100 around the torso of the lifter 700. In an embodiment, the torso support portion 105 is made of polyester.

FIG. 6 illustrates a rear top perspective view of the weight lifting support shirt 100. FIG. 7 exemplarily illustrates a front top perspective view of the weight lifting support shirt 100 that is being used by the lifter 700 during a bench press workout. In an embodiment, the chest support portion 101 is made of an elastic material. The chest support portion 101 is configured to stretch the elastic material of the chest support portion 101 and store energy in the elastic material of the chest support portion 101 when the weight 702 is lowered by the lifter 700. The energy is stored and concentrated at about the center of the weight lifting support shirt 100. The stored energy is conserved until the lifter 700 presses the weight 702 away from the lifter's body 706. When the lifter 700 presses the weight 702 away from the body 706, the stored and concentrated energy rebounds through the chest portion 701 and triceps of the lifter 700 and facilitates the lifting of the weight.

Figure 10:
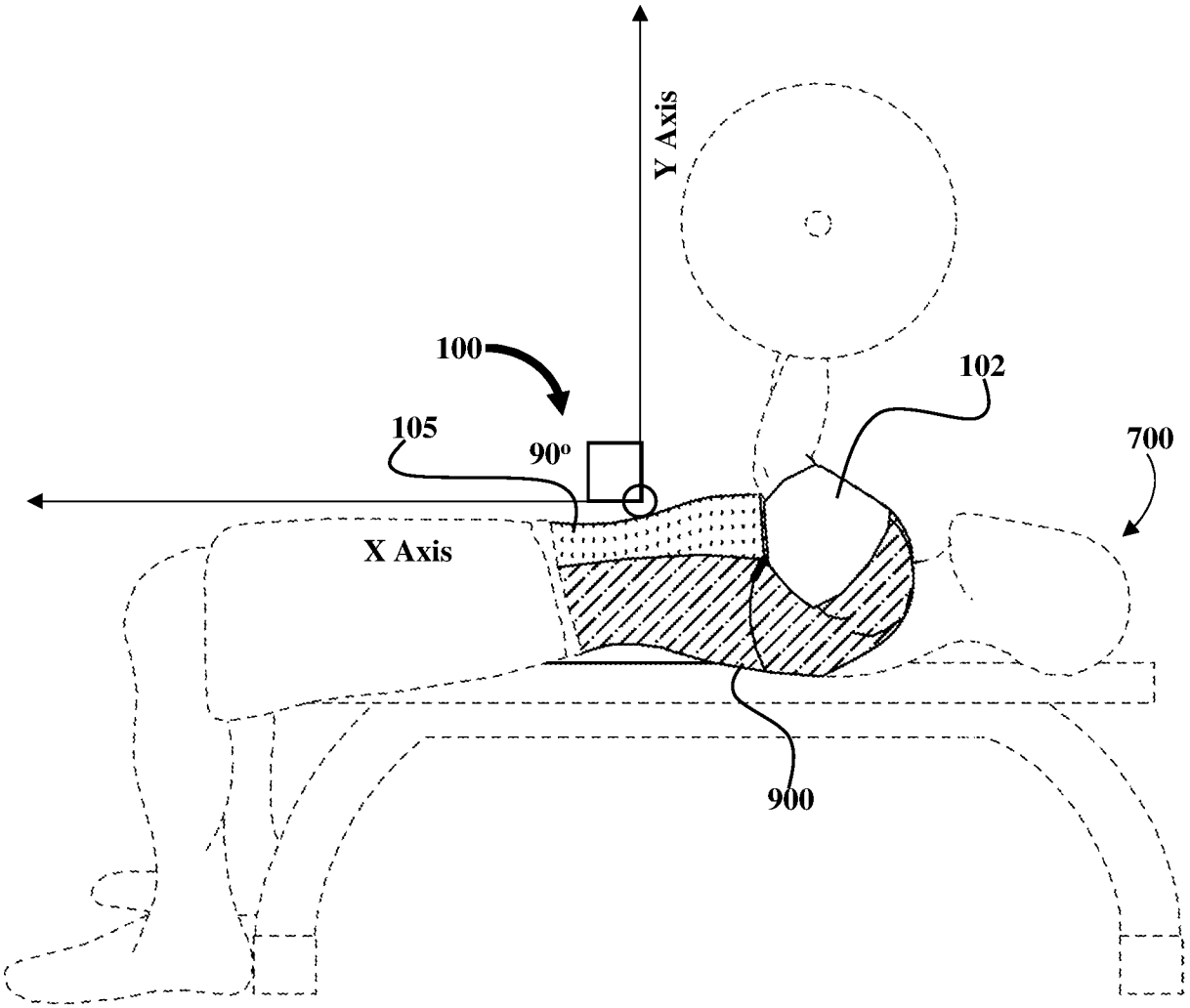
FIG. 10 illustrates a side perspective view showing a barbell path when the lifter uses the weight lifting support shirt during the bench press workout.

FIG. 8 exemplarily illustrates a top view of the weight lifting support shirt 100 that is being used by the lifter 700 during a bench press workout. FIG. 9 illustrates a right-side view of the weight lifting support shirt 100 worn by the lifter 700 during the bench press workout. FIG. 10 illustrates a side perspective view showing a weight 702 path when the lifter 700 uses the weight lifting support shirt 100 during the bench press workout. As shown in FIGS. 8, 9, and 10, the weight lifting support shirt 100 aligns the hands 202 and 203 of the lifter 700 to move along a predetermined bar path. The predetermined bar path, illustrated in FIG. 10, along the y-axis, conforms to the bar path that is utilized in a proper bench press exercise. Furthermore, an angle at which the first and second arm support portions 102 and 103 are aligned with the chest support portion 101 of the lifter 700 is configured in a manner that requires the lifter 700 to move the weight 702, for example, the weight 702 in a substantially straight path, along the y-axis, that is substantially perpendicular to the ground. The first and second arm portions 102 and 103 transfer the load and energy of the weight 702 to about the center of the weight lifting support shirt 100 during descent of the weight 702. FIG. 11 illustrates a top view of the weight lifting support shirt 100 when the lifter 700 is seated.

The neck relief portion 104 also stores energy when the lifter 700 lowers the weight 702 which causes the elastic neck relief portion 104 to stretch. Furthermore, the first arm support portion 102, the second arm support portion 103 and the neck relief portion 104 are configured to transfer the load of the weight 702 from the first and second shoulders 704*a* and 704*b* of the lifter 700 into the triceps, pectoral and latissimus regions of the lifter 700. The energy stored during the descent of the weight 702 is conserved in the neck relief portion 104 until the lifter 700 presses the weight 702 away from the body 706. When the lifter 700 presses the weight 702 away from the body 706, the neck relief portion 104 retracts back to its previous unstretched energy state, thus releasing the energy stored in the neck relief portion 104. Likewise, the chest support portion 101 is configured to store energy when the lifter 700 lowers the weight 702 and stretches the elastic material of the chest support portion 101. The grid plate 107 resists stretching of the material of the chest support portion 101 of the weight lifting support shirt 100 during the descent of the weight 702, thereby enabling the material of the chest support portion 101 outside the area of the grid plate 107 bound by the four-sided parallelogram formed by the figure eight stitching 107*a* to stretch and store energy. The energy received and concentrated at the center of the weight lifting support shirt 100 by the stretching of the material of the chest support portion 101 is stored until the lifter 700 presses the weight 702 away from the body 706, when the stored energy is rebounded through the chest portion 701 and triceps of the lifter. The stored energy is released when the material of the chest support portion 101 outside the area of the grid plate 107, bound by the four-sided parallelogram formed by the figure eight stitching 107*a*, is restored to its normal unstretched state as the lifter 700 presses the weight 702 away from the body 706.

Figure 12:
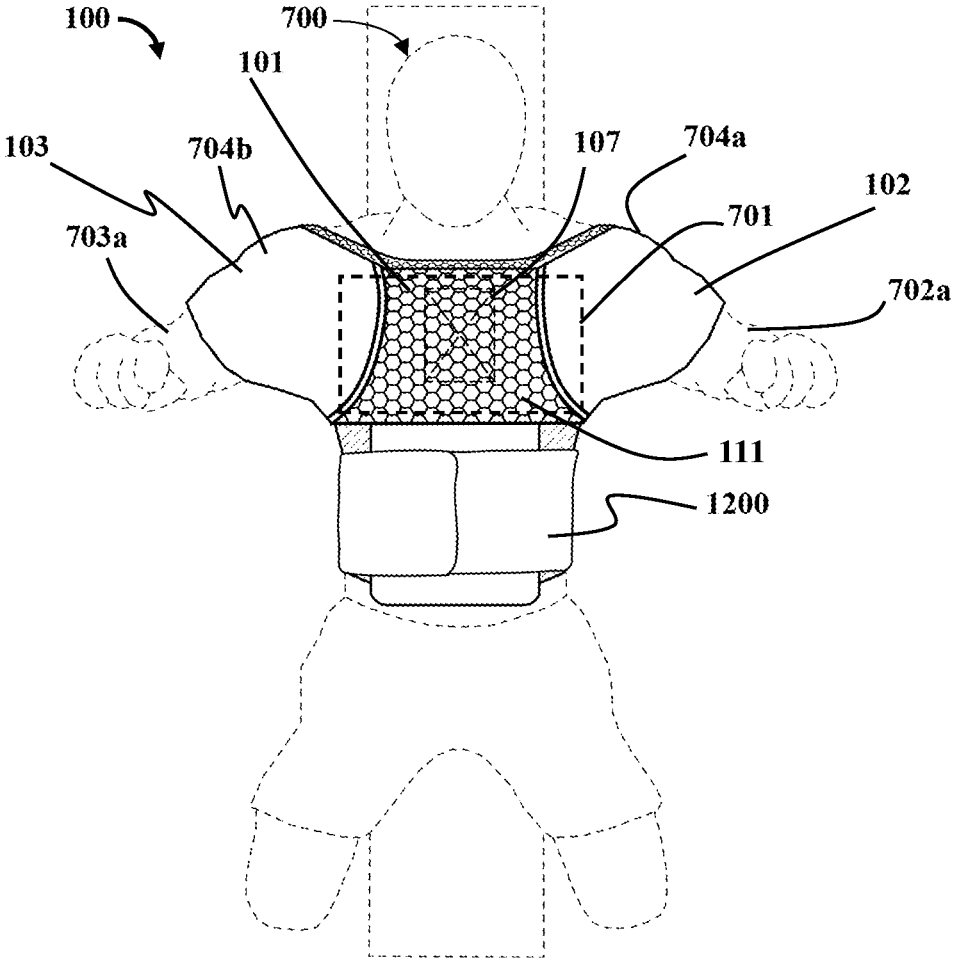
FIG. 12 exemplarily illustrates a top view of the weight lifting support shirt that is being used by the lifter during a bench press workout along with a stomach protector.

FIG. 11 illustrates a top view of the weight lifting support shirt 100 when the lifter 700 is seated. FIG. 12 exemplarily illustrates a top view of the weight lifting support shirt 100 that is being used by the lifter 700 during a bench press workout along with a stomach protector 1200. In an embodiment, the user 700 uses the stomach protector 1200 when the user 700 is wearing the weight lifting support shirt 100. The stomach protector 1200 is disposed below the lower elastic section 111 over the user's abdomen 707 when the user 700 is wearing the weight lifting support shirt 100. The stomach protector 1200 is made of the same resilient material as the sleeves 109 and 110, and the lower and upper elastic sections 111 and 112.

The foregoing examples have been provided merely for explanation and are in no way to be construed as limiting of the weight lifting support shirt 100 disclosed herein. While the weight lifting support shirt 100 has been described with reference to various embodiments, it is understood that the words, which have been used herein, are words of description and illustration, rather than words of limitation. Furthermore, although the weight lifting support shirt 100 has been described herein with reference to particular means, materials, and embodiments, the weight lifting support shirt 100 are not intended to be limited to the particulars disclosed herein; rather, the weight lifting support shirt 100 extend to all functionally equivalent structures, methods and uses, such as are within the scope of the appended claims. While multiple embodiments are disclosed, it will be understood by those skilled in the art, having the benefit of the teachings of this specification, that weight lifting support shirt 100 disclosed herein are capable of modifications and other embodiments may be effected and changes may be made thereto, without departing from the scope and spirit of the weight lifting support shirt 100 disclosed herein.

I claim:

1. A weight lifting support shirt, comprising:

a chest support portion comprising a material and configured to extend across a chest portion of a lifter from a first end to a second end of the chest support portion;

a first arm support portion extending from the first end of the chest support portion;

a second arm support portion extending from the second end of the chest support portion, wherein the first arm support portion is configured to accommodate and support a first upper arm of the lifter and the second arm support portion is configured to accommodate and support a second upper arm of the lifter;

a neck relief portion attached to an upper boundary of the chest support portion, wherein the neck relief portion connects the first arm support portion to the second arm support portion, wherein the neck relief portion comprises a first elastic material configured to stretch and to store energy when a weight is lowered by the lifter, and wherein the first elastic material is configured to release the stored energy and return to an unstretched state when the weight is raised by the lifter while performing a workout with the weight;

a torso support portion in communication with and extending below the chest support portion;

a first lateral extension extending from the first arm support portion and a first lateral side of the torso support portion;

a second lateral extension extending from the second arm support portion and a second lateral side of the torso support portion, wherein the first lateral extension is configured to wrap around a first shoulder and a back of the lifter, and wherein the second lateral extension is configured to wrap around a second shoulder and the back of the lifter;

a grid plate disposed about a center of the chest support portion, wherein the grid plate is configured to resist stretching of the material of the chest support portion when the weight is lowered by the lifter and to store energy of the weight when the weight is lowered, and to rebound the stored energy into the chest portion and arms of the lifter when the weight is lifted by the lifter during the workout, wherein the grid plate comprises a figure eight stitching, and wherein the figure eight stitching is configured to further direct load and energy received from multiple angles during the workout, towards a center of the weight lifting support shirt.

2. The weight lifting support shirt of claim 1, wherein the figure eight stitching is sewn into the chest support portion using one of a non-stretchable thread and a stretch resistant thread, wherein the figure eight stitching is stitched in the shape of a four-sided parallelogram comprising four sides and two diagonals, and wherein the figure eight stitching reduces stretching of the material of the chest support portion in an area of the grid plate bound by the four-sided parallelogram formed by the figure eight stitching.

3. The weight lifting support shirt of claim 1, wherein the first arm support portion comprises a sleeve configured to enclose the first upper arm of the lifter and the second arm support portion comprises a sleeve configured to enclose the second upper arm of the lifter, wherein the sleeve of the first arm support portion is configured to extend from the first shoulder to an elbow of the first upper arm of the lifter, wherein the sleeve of the second arm support is configured to extend from the second shoulder to an elbow of the second upper arm of the lifter, wherein each of the sleeves are in the shape of a truncated cone with a truncated end of each sleeve corresponding with a respective elbow end of each of the sleeves, and wherein each of the sleeves is configured to accommodate and support the lifter's deltoid, biceps and triceps muscles.

4. The weight lifting support shirt of claim 1, wherein the energy stored by the first elastic material, when stretched, is configured to allow the lifter to press the weight away from the lifter's body when the weight is raised by the lifter.

5. The weight lifting support shirt of claim 1, wherein the material of the chest support portion is made of a second elastic material, and wherein the chest support portion is configured to stretch and to store energy when the weight is lowered by the lifter, wherein the energy is stored and concentrated at the center of the weight lifting support shirt, and wherein the weight lifting support shirt is configured to rebound the stored and concentrated energy through the chest portion and triceps of the lifter when the lifter presses the weight away from the lifter's body.

6. The weight lifting support shirt of claim 1, wherein the first lateral extension comprises a loop component of a hook and loop fastener, the loop component being attached to a lower surface of the first lateral extension.

7. The weight lifting support shirt of claim 6, wherein the second lateral extension comprises a hook component of the hook and loop fastener, the hook component being attached to an upper surface of the second lateral extension.

8. The weight lifting support shirt of claim 7, wherein the torso support portion, the first lateral extension, and the second lateral extension are configured to be fastened about the torso of the lifter using the hook and loop fastener.

9. The weight lifting support shirt of claim 1, wherein the first lateral extension is longer than the second lateral extension, and wherein the first lateral extension is configured to overlap the second lateral extension when the weight lifting support shirt is worn by the lifter.

10. The weight lifting support shirt of claim 1, wherein the weight lifting support shirt is configured to align the arms of the lifter to move along a predetermined bar path.

11. The weight lifting support shirt of claim 10, wherein the weight lifting support shirt is configured to guide the weight along the predetermined bar path for a bench press exercise.

12. The weight lifting support shirt of claim 1, wherein the first and second arm support portions connecting to the chest support portion are configured in a manner that requires the lifter to move the weight in a straight path perpendicular to ground.

13. The weight lifting support shirt of claim 12, wherein the first and second arm support portions are configured to transfer load and energy of the weight to the center of the weight lifting support shirt during descent of the weight.

14. The weight lifting support shirt of claim 1, wherein the first arm support portion, the second arm support portion and the neck relief portion are configured to transfer weight from the first and second shoulders of the lifter into biceps, triceps, pectoral and latissimus regions of the lifter.

15. The weight lifting support shirt of claim 1, wherein the neck relief portion and the chest support portion are made of the same material.

16. The weight lifting support shirt of claim 1, wherein the weight is a barbell.

* * * * *